US008210268B2

(12) United States Patent
Heidecke et al.

(10) Patent No.: US 8,210,268 B2
(45) Date of Patent: Jul. 3, 2012

(54) TOP DRIVE SYSTEM

(75) Inventors: Karsten Heidecke, Houston, TX (US); Joseph Ross Rials, Tomball, TX (US); Raleigh Fisher, Houston, TX (US); Delaney Michael Olstad, Clear Lake, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 188 days.

(21) Appl. No.: 12/334,193

(22) Filed: Dec. 12, 2008

(65) Prior Publication Data

US 2009/0151934 A1 Jun. 18, 2009

Related U.S. Application Data

(60) Provisional application No. 61/013,235, filed on Dec. 12, 2007.

(51) Int. Cl.
*E21B 19/16* (2006.01)
*E21B 23/00* (2006.01)

(52) U.S. Cl. ..... 166/380; 166/77.51; 166/77.52; 166/382

(58) Field of Classification Search ..... 166/77.51, 166/77.52, 380, 382
See application file for complete search history.

(56) References Cited

U.S. PATENT DOCUMENTS

| | | | |
|---|---|---|---|
| 3,662,842 | A | 5/1972 | Bromell |
| 3,747,675 | A | 7/1973 | Brown |
| 3,766,991 | A | 10/1973 | Brown |
| 3,776,320 | A | 12/1973 | Brown |
| 3,915,244 | A | 10/1975 | Brown |
| 3,964,552 | A | 6/1976 | Slator |
| 4,051,587 | A | 10/1977 | Boyadjieff |
| 4,100,968 | A | 7/1978 | Delano |
| 4,192,155 | A | 3/1980 | Gray |
| 4,235,469 | A | 11/1980 | Denny et al. |
| 4,449,596 | A | 5/1984 | Boyadjieff |
| 4,762,187 | A | 8/1988 | Haney |
| 4,813,493 | A | 3/1989 | Shaw et al. |
| 4,815,546 | A | 3/1989 | Haney et al. |
| 4,821,814 | A | 4/1989 | Willis et al. |
| 4,867,236 | A | 9/1989 | Haney et al. |
| 5,036,927 | A | 8/1991 | Willis |
| 5,297,833 | A | 3/1994 | Willis et al. |
| 5,433,279 | A | 7/1995 | Tessari et al. |
| 5,645,131 | A | 7/1997 | Trevisani |
| 5,839,330 | A | 11/1998 | Stokka |

(Continued)

FOREIGN PATENT DOCUMENTS

EP 1 619 349 1/2006

(Continued)

OTHER PUBLICATIONS

PCT Search Report for International Application No. PCT/US2008/086699 dated Sep. 9, 2009.

(Continued)

*Primary Examiner* — Cathleen Hutchins
(74) *Attorney, Agent, or Firm* — Patterson & Sheridan, LLP

(57) ABSTRACT

In one embodiment, a top drive system includes a quill; a motor operable to rotate the quill; a gripper operable to engage a joint of casing; a connector bi-directionally rotationally coupled to the quill and the gripper and longitudinally coupled to the gripper; and a compensator longitudinally coupled to the quill and the connector. The compensator is operable to allow relative longitudinal movement between the connector and the quill.

32 Claims, 20 Drawing Sheets

U.S. PATENT DOCUMENTS

| | | | |
|---|---|---|---|
| 6,102,116 | A | 8/2000 | Giovanni |
| 6,142,545 | A | 11/2000 | Penman et al. |
| 6,161,617 | A | 12/2000 | Gjedebo |
| 6,276,450 | B1 | 8/2001 | Seneviratne |
| 6,309,002 | B1 | 10/2001 | Bouligny |
| 6,311,792 | B1 | 11/2001 | Scott et al. |
| 6,378,630 | B1 | 4/2002 | Ritorto et al. |
| 6,431,626 | B1 | 8/2002 | Bouligny |
| 6,443,241 | B1 | 9/2002 | Juhasz et al. |
| 6,527,047 | B1 | 3/2003 | Pietras |
| 6,536,520 | B1 | 3/2003 | Snider et al. |
| 6,622,796 | B1 | 9/2003 | Pietras |
| 6,637,526 | B2 | 10/2003 | Juhasz et al. |
| 6,679,333 | B2 | 1/2004 | York et al. |
| 6,688,398 | B2 | 2/2004 | Pietras |
| 6,691,801 | B2 | 2/2004 | Juhasz et al. |
| 6,705,405 | B1 | 3/2004 | Pietras |
| 6,725,938 | B1 | 4/2004 | Pietras |
| 6,732,822 | B2 | 5/2004 | Slack et al. |
| 6,742,584 | B1 | 6/2004 | Appleton |
| 6,742,596 | B2 | 6/2004 | Haugen |
| 6,892,835 | B2 | 5/2005 | Shahin et al. |
| 6,938,697 | B2 | 9/2005 | Haugen |
| 6,976,298 | B1 | 12/2005 | Pietras |
| 6,994,176 | B2 | 2/2006 | Shahin et al. |
| 7,004,259 | B2 | 2/2006 | Pietras |
| 7,007,753 | B2 | 3/2006 | Robichaux et al. |
| 7,021,374 | B2 | 4/2006 | Pietras |
| 7,025,130 | B2 | 4/2006 | Bailey et al. |
| 7,073,598 | B2 | 7/2006 | Haugen |
| 7,090,021 | B2 | 8/2006 | Pietras |
| 7,128,161 | B2 | 10/2006 | Pietras |
| 7,137,454 | B2 | 11/2006 | Pietras |
| 7,140,443 | B2 | 11/2006 | Beierbach et al. |
| 7,143,849 | B2 | 12/2006 | Shahin et al. |
| 7,213,656 | B2 | 5/2007 | Pietras |
| 7,219,744 | B2 | 5/2007 | Pietras |
| 7,270,189 | B2 | 9/2007 | Brown et al. |
| 7,281,587 | B2 | 10/2007 | Haugen |
| 7,303,022 | B2 | 12/2007 | Tilton et al. |
| 7,325,610 | B2 | 2/2008 | Giroux et al. |
| 7,353,880 | B2 | 4/2008 | Pietras |
| 7,448,456 | B2 | 11/2008 | Shahin et al. |
| 7,451,826 | B2 | 11/2008 | Pietras |
| 7,503,397 | B2 | 3/2009 | Giroux et al. |
| 7,513,300 | B2 | 4/2009 | Pietras et al. |
| 7,617,866 | B2 | 11/2009 | Pietras |
| 7,665,531 | B2 | 2/2010 | Pietras |
| 7,699,121 | B2 | 4/2010 | Juhasz et al. |
| 7,712,523 | B2 | 5/2010 | Snider et al. |
| 7,793,719 | B2 | 9/2010 | Snider et al. |
| 7,874,352 | B2 | 1/2011 | Odell, II et al. |
| 7,896,084 | B2 | 3/2011 | Haugen |
| 7,918,273 | B2 | 4/2011 | Snider et al. |
| 2002/0074132 | A1* | 6/2002 | Juhasz et al. ..... 166/380 |
| 2004/0216924 | A1* | 11/2004 | Pietras et al. ..... 175/57 |
| 2005/0000691 | A1 | 1/2005 | Giroux et al. |
| 2005/0257933 | A1 | 11/2005 | Pietras |
| 2005/0269104 | A1* | 12/2005 | Folk et al. ..... 166/379 |
| 2006/0180315 | A1 | 8/2006 | Shahin et al. |
| 2007/0074874 | A1 | 4/2007 | Richardson |
| 2007/0131416 | A1 | 6/2007 | Odell, II et al. |
| 2007/0144730 | A1 | 6/2007 | Shahin et al. |
| 2007/0158076 | A1 | 7/2007 | Hollingsworth, Jr. et al. |
| 2007/0251701 | A1 | 11/2007 | Jahn et al. |
| 2008/0125876 | A1* | 5/2008 | Boutwell ..... 700/21 |
| 2008/0308281 | A1 | 12/2008 | Boutwell, Jr. et al. |
| 2009/0274545 | A1 | 11/2009 | Liess et al. |

FOREIGN PATENT DOCUMENTS

| | | |
|---|---|---|
| GB | 2 228 025 | 8/1990 |
| WO | WO2004/079153 | 9/2004 |
| WO | WO 2004/101417 | 11/2004 |

OTHER PUBLICATIONS

PCT Search Report for International Application No. PCT/US2008/086699 dated Nov. 9, 2009.

Australian Examination Report for Application No. 2008334992 dated Apr. 5, 2011.

EP Office Action for Application No. 08 860 261.0—2315 dated Apr. 12, 2011.

* cited by examiner

TOP DRIVE SYSTEM

CROSS-REFERENCE TO RELATED APPLICATIONS

This application claims benefit of U.S. Provisional Pat. App. No. 61/013,235, filed Dec. 12, 2007, which is hereby incorporated by reference in its entirety.

BACKGROUND OF THE INVENTION

In wellbore construction and completion operations, a wellbore is initially formed to access hydrocarbon-bearing formations (i.e., crude oil and/or natural gas) by the use of drilling. Drilling is accomplished by utilizing a drill bit that is mounted on the end of a tubular string, commonly known as a drill string. To drill within the wellbore to a predetermined depth, the drill string is often rotated by a top drive or rotary table on a surface platform or rig, and/or by a downhole motor mounted towards the lower end of the drill string. After drilling to a predetermined depth, the drill string and drill bit are removed and a section of casing is lowered into the wellbore. An annular area is thus formed between the string of casing and the formation. The casing string is temporarily hung from the surface of the well. A cementing operation is then conducted in order to fill the annular area with cement. Using apparatus known in the art, the casing string is cemented into the wellbore by circulating cement into the annular area defined between the outer wall of the casing and the borehole. The combination of cement and casing strengthens the wellbore and facilitates the isolation of certain areas of the formation behind the casing for the production of hydrocarbons.

A drilling rig is constructed on the earth's surface to facilitate the insertion and removal of tubular strings (i.e., drill strings or casing strings) into a wellbore. Alternatively, the drilling rig may be disposed on a jack-up platform, semi-submersible platform, or a drillship for drilling a subsea wellbore. The drilling rig includes a platform and power tools such as a top drive and a spider to engage, assemble, and lower the tubulars into the wellbore. The top drive is suspended above the platform by a draw works that can raise or lower the top drive in relation to the floor of the rig. The spider is mounted in the platform floor. The top drive and spider are designed to work in tandem. Generally, the spider holds a tubular or tubular string that extends into the wellbore from the platform. The top drive engages a new tubular and aligns it over the tubular being held by the spider. The top drive is then used to thread the upper and lower tubulars together. Once the tubulars are joined, the spider disengages the tubular string and the top drive lowers the tubular string through the spider until the top drive and spider are at a predetermined distance from each other. The spider then re-engages the tubular string and the top drive disengages the string and repeats the process. This sequence applies to assembling tubulars for the purpose of drilling, running casing or running wellbore components into the well. The sequence can be reversed to disassemble the tubular string.

Top drives are used to rotate a drill string to form a borehole. Top drives are equipped with a motor to provide torque for rotating the drilling string. The quill or drive shaft of the top drive is typically threadedly connected to an upper end of the drill pipe in order to transmit torque to the drill pipe. Top drives may also be used to make up casing for lining the borehole. To make-up casing, existing top drives use a threaded crossover adapter to connect to the casing. This is because the quill of the top drives is typically not sized to connect with the threads of the casing. The crossover adapter is design to alleviate this problem. Generally, one end of the crossover adapter is designed to connect with the quill, while the other end is designed to connect with the casing. In this respect, the top drive may be adapted to retain a casing using a threaded connection. However, the process of connecting and disconnecting a casing using a threaded connection is time consuming. For example, each time a new casing is added, the casing string must be disconnected from the crossover adapter. Thereafter, the crossover must be threaded to the new casing before the casing string may be run. Furthermore, the threading process also increases the likelihood of damage to the threads, thereby increasing the potential for downtime.

As an alternative to the threaded connection, top drives may be equipped with tubular gripping heads to facilitate the exchange of wellbore tubulars such as casing or drill pipe. Generally, tubular gripping heads have an adapter for connection to the quill of top drive and gripping members for gripping the wellbore tubular. Tubular gripping heads include an external gripping device, such as a torque head, or an internal gripping device, such as a spear.

FIG. 1A is a side view of an upper portion of a drilling rig 10 having a top drive 100 and an elevator assembly 35. The elevator assembly 35 may include a piston and cylinder assembly (PCA) 35*a*, a bail 35*b*, and an elevator 35*c*. An upper end of a stand of casing joints 70 is shown on the rig 10. The elevator assembly 35 is engaged with one of the stands 70. The stand 70 is placed in position below the top drive 100 by the elevator assembly 35 in order for the top drive having a gripping head, such as a spear 190, to engage the tubular.

FIG. 1B is a side view of a drilling rig 10 having a top drive 100, an elevator assembly 35, and a spider 60. The rig 10 is built at the surface 45 of the wellbore 50. The rig 10 includes a traveling block 20 that is suspended by wires 25 from draw works 15 and holds the top drive 100. The top drive 100 has the spear 190 for engaging the inner wall of the casing 70 and a motor 140 to rotate the casing 70. The motor 140 may be either electrically or hydraulically driven. The motor 140 rotates and threads the casing 70 into the casing string 80 extending into the wellbore 50. Additionally, the top drive 100 is shown having a railing system 30 coupled thereto. The railing system 30 prevents the top drive 100 from rotational movement during rotation of the casing 70, but allows for vertical movement of the top drive under the traveling block 110. The top drive 100 is shown engaged to casing 70. The casing 70 is positioned above the casing string 80 located therebelow. With the casing 70 positioned over the casing string 80, the top drive 100 can lower casing 70 into the casing string 80. Additionally, the spider 60, disposed in a platform 40 of the drilling rig 10, is shown engaged around the casing string 80 that extends into wellbore 50.

FIG. 1C illustrates a side view of the top drive 100 engaged to the casing 70, which has been connected to the casing string 80 and lowered through the spider 60. The elevator assembly 35 and the top drive 100 are connected to the traveling block 20 via a compensator 170. The compensator 170 functions similar to a spring to compensate for vertical movement of the top drive 100 during threading of the casing 70 to the casing string 80. FIG. 1C also illustrates the spider 60 disposed in the platform 40. The spider 60 comprises a slip assembly 66, including a set of slips 62, and piston 64. The slips 62 are wedge-shaped and are constructed and arranged to slide along a sloped inner wall of the slip assembly 66. The slips 62 are raised or lowered by piston 64. When the slips 62 are in the lowered position, they close around the outer surface of the casing string 80. The weight of the casing string 80 and the resulting friction between the tubular string 80 and the slips 62, force the slips downward and inward, thereby tightening the grip on the casing string. When the slips 62 are in the raised position as shown, the slips are opened and the casing string 80 is free to move longitudinally in relation to the slips.

A typical operation of a adding a casing joint or stand of joints to a casing string using a top drive and a spider is as follows. A tubular string 80 is retained in a closed spider 60 and is thereby prevented from moving in a downward direction. The top drive 100 is then moved to engage the casing joint/stand 70 from a stack with the aid of the elevator assembly 35. Engagement of the casing 70 by the top drive 100 includes grasping the casing and engaging the inner (or outer) surface thereof. The top drive 100 then moves the casing 70 into position above the casing string 80. The top drive 100 then threads the casing 70 to casing string 80. The spider 60 is then opened and disengages the casing string 80. The top drive 100 then lowers the casing string 80, including casing 70, through the opened spider 60. The spider 60 is then closed around the tubular string 80. The top drive 100 then disengages the tubular string 80 and can proceed to add another joint/stand of casing 70 to the casing string 80.

The adapter of the tubular gripping head (i.e. spear 190) connects to the quill of the top drive using a threaded connection. The adapter may be connected to the quill either directly or indirectly, e.g., through another component such as a sacrificial saver sub. One problem that may occur with the threaded connection is inadvertent breakout of that connection during operation. For example, a casing connection may be required to be backed out (i.e., unthreaded) to correct an unacceptable makeup. It may be possible that the left hand torque required to break out the casing connection exceeds the breakout torque of the connection between the adapter and the quill, thereby inadvertently disconnecting the adapter from the quill and creating a hazardous situation on the rig. There is a need, therefore, for methods and apparatus for ensuring safe operation of a top drive.

Further, each joint of conventional casing has an internal threading at one end and an external threading at another end. The externally-threaded end of one length of tubing is adapted to engage in the internally-threaded end of another length of tubing. These connections between lengths of casing rely on thread interference and the interposition of a thread compound to provide a seal.

As the petroleum industry has drilled deeper into the earth during exploration and production, increasing pressures have been encountered. In such environments, it may be beneficial to employ premium grade casing joints which include a metal-to-metal sealing area or engaged shoulders in addition to the threads. It would be advantageous to employ top drives in the make-up of premium casing joints. Current measurements are obtained by measuring the voltage and current of the electricity supplied to an electric motor or the pressure and flow rate of fluid supplied to a hydraulic motor. Torque is then calculated from these measurements. This principle of operation neglects friction inside a transmission gear of the top drive and inertia of the top drive, which are substantial. Therefore, there exists a need in the art for a more accurate top drive torque measurement.

SUMMARY OF THE INVENTION

In one embodiment, a top drive system includes a quill; a motor operable to rotate the quill; a gripper operable to engage a joint of casing; a connector bi-directionally rotationally coupled to the quill and the gripper and longitudinally coupled to the gripper; and a compensator longitudinally coupled to the quill and the connector. The compensator is operable to allow relative longitudinal movement between the connector and the quill.

In another embodiment, a method of using a top drive includes injecting drilling fluid through a quill of the top drive and into a drill string disposed in a wellbore. The drill string is connected to a first adapter with a threaded connection and the first adapter is bidrectionally rotationally coupled to the quill. The method further includes rotating a drill bit connected to a lower end of the drill string, thereby drilling the wellbore; operating an actuator thereby releasing the first adaptor from the quill; and engaging a second adaptor with the quill. A casing gripper is bidrectionally rotationally and longitudinally coupled to the second adapter. The method further includes operating the actuator, thereby bidrectionally rotationally coupling the quill and the second adapter.

In another embodiment, a method of making up a joint or stand of casing with a casing string using a top drive includes engaging the joint or stand of casing with a casing gripper of the top drive. The casing gripper is bidrectionally rotationally coupled to a quill of the top drive. The method further includes rotating the joint or stand of casing relative casing string using the casing gripper, thereby making up the joint or stand of casing with the casing string. The casing gripper is longitudinally coupled to a compensator and the compensator allows longitudinal movement of the gripper relative to a quill of the top drive during makeup. The method further includes longitudinally coupling the casing gripper to the quill or a motor of the top drive; and lowering the joint or stand of casing into a wellbore.

In another embodiment, a top drive system includes a quill having a bore formed therethrough; a motor operable to rotate the quill; a gripper operable to engage a joint of casing; and a connector rotationally coupled to the quill and the gripper and longitudinally coupled to the gripper and having a bore formed therethrough; a seal engaging the connector and the quill, thereby isolating fluid communication between the quill and connector bores; and a first conduit extending along the quill to the connector and a second conduit extending from the connector to the gripper. The connector connects the two conduits.

In another embodiment, a method of using a top drive includes injecting drilling fluid through a quill of the top drive and into a drill string disposed in a wellbore. The drill string is connected to a first adapter with a threaded connection and a control line extending along the drill string is in communication with a control line extending along the quill via the first adapter. The method further includes rotating a drill bit connected to a lower end of the drill string, thereby drilling the wellbore; releasing the first adapter from the quill; and connecting a second adapter to the quill. A casing gripper is connected to the second adapter and a control line of the casing gripper is in communication with the quill control line via the second adapter.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Figure 2:
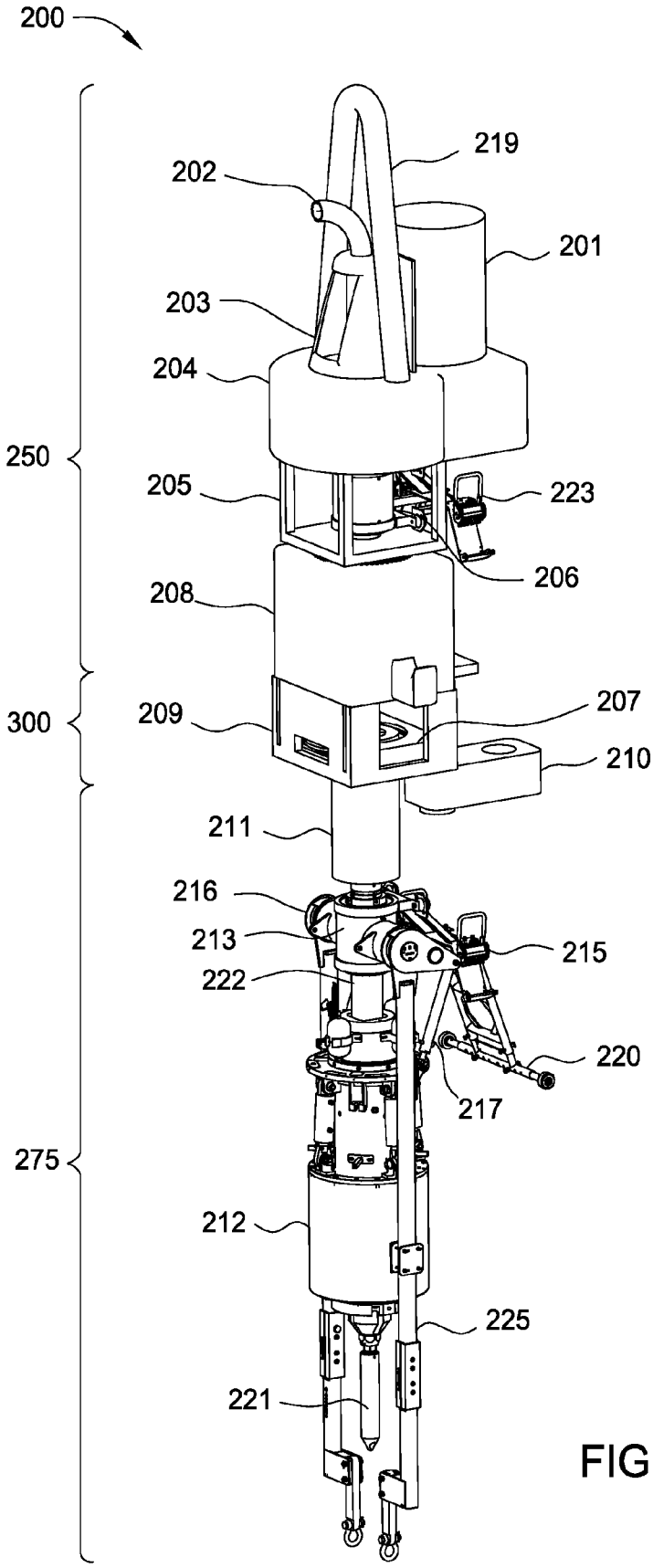
FIG. 2 illustrates a top drive casing makeup system, according to one embodiment of the present invention.

FIG. 2 illustrates a top drive casing makeup system 200, according to one embodiment of the present invention. The system 200 may include a top drive assembly 250, a makeup assembly 275, and a quick connect assembly 300. The top drive assembly 250 may include a motor 201, a drilling fluid conduit connection 202, a hydraulic swivel 203, a gearbox 204, a torque sub frame 205, a torque sub 206, a drill pipe link-tilt body 208, a drill pipe back-up wrench 210, a quill 214 (FIG. 2A), a manifold 223, and traveling block bail 219. The makeup assembly 275 may include an adapter 211, a torque head 212, a hydraulic swivel 213, a torque head manifold 215, a casing link-tilt body 216, a casing link-tilt 217, hydraulic swivel rail bracket 220, circulation head 221, drive shaft 222, and casing bails 225.

The quick connect assembly 300 may rotationally and longitudinally couple the makeup assembly 275 to the top drive assembly 250 in the engaged position. The quick connect assembly 300 be remotely actuated between the engaged position and a disengaged position, thereby releasing the makeup assembly and allowing change-out to a drill pipe adaptor (not shown). The drill pipe adaptor may include a first end identical to the adapter 211 and a second end having a threaded pin or box for engagement with drill pipe. As discussed above, connection of the quill to the adapter with a conventional threaded connection is susceptible to unintentional disconnection upon exertion of counter torque on the casing 70. The quick connect system 300 may bi-directionally rotationally couple the quill 214 to the adapter 211, thereby transmitting torque from the quill 214 to the adapter 211 in both directions (i.e., left-hand and right-hand torque) and preventing un-coupling of the adapter 211 from the quill 214 when counter (i.e., left hand) torque is exerted on the casing 70.

The bail 219 may receive a hook of the traveling block 20, thereby longitudinally coupling the top drive assembly 250 to the traveling block 20. The top drive motor 201 may be electric or hydraulic. The motor 201 may be rotationally coupled to the rail 30 so that the motor 201 may longitudinally move relative to the rail 30. The gearbox 204 may include a gear in rotational communication with the motor 201 and the quill 214 to increase torque produced by the motor 201. The gearbox 204 may be longitudinally coupled to the bail 219 and longitudinally and rotationally coupled to the motor 201. The swivel 203 may provide fluid communication between the non-rotating drilling fluid connection 202 and the rotating quill 214 (or a swivel shaft rotationally and longitudinally coupled to the quill 214) for injection of drilling fluid from the rig mud pumps (not shown) through the makeup system 200, and into the casing 70. The swivel 203 may be longitudinally and rotationally coupled to the gearbox 204. The manifold 223 may connect hydraulic, electrical, and/or pneumatic conduits from the rig floor to the top drive 201, drill pipe link-tilt body 208, torque sub 206, and quick connect system 300. The manifold 223 may be longitudinally and rotationally coupled to the frame 205. The frame 205 may be longitudinally and rotationally coupled to the gearbox 204 and the torque sub 206 (discussed below).

Figure 2A:
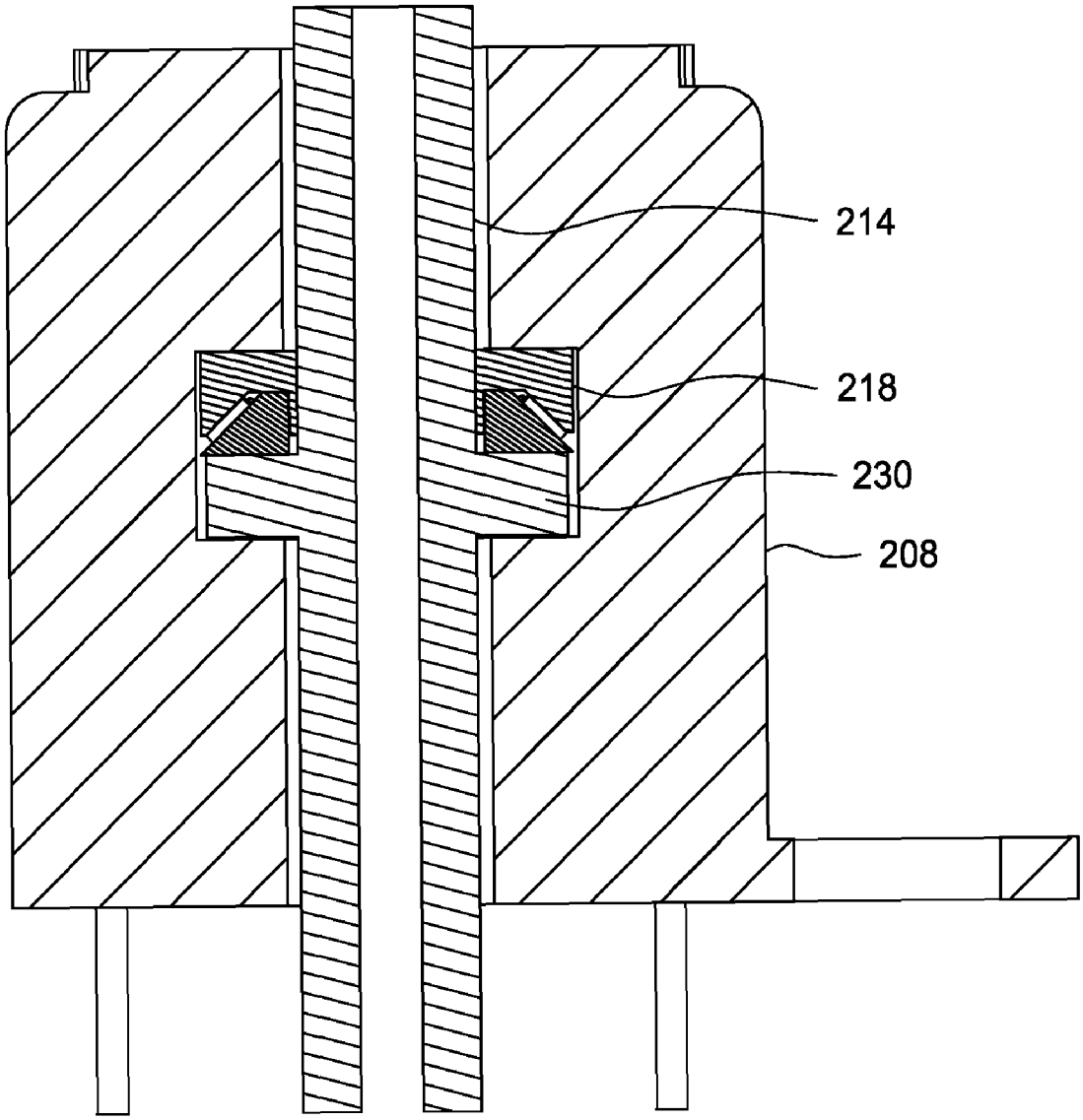
FIG. 2A illustrates an interface between the drill pipe elevator and the quill.

FIG. 2A illustrates an interface between the drill pipe link-tilt body 208 and the quill 214. The link-tilt body 208 may be longitudinally coupled to the quill 214 by a thrust bearing 218. The quill 214 may have a shoulder 230 formed around an outer surface thereof for engaging the thrust bearing 218. Alternatively, a bearing shaft longitudinally and rotationally coupled to the quill 214 may be used instead of the quill. The link-tilt body 208 may be rotationally coupled to the rail 30 so that the link-tilt body 208 may longitudinally move relative to the rail 30. The link-tilt body 208 may include bails (not shown), an elevator (not shown), and a link-tilt (not shown), such as a piston and cylinder assembly (PCA), for pivoting the bails and elevator to engage and hoist a joint or stand of drill pipe and aligning the drill pipe for engagement with the drill pipe adapter. The wrench 210 may be supported from the link-tilt body 208 by a shaft. The wrench 210 may hold the drill pipe between disengagement from the bails and engagement with the drill pipe adapter and hold the drill pipe while the top drive rotates the drill pipe adapter to make up the connection between the adapter and the drill pipe. The link-tilt body 208 may further include a motor for rotating the wrench shaft so that the wrench may be moved into a position to grip drill pipe and then rotated out of the way for casing makeup operations. The wrench 210 may also be vertically movable relative to the link-tilt body 208 to move into position to grip the drill pipe and then hoisted out of the way for casing operations. The wrench 210 may also longitudinally extend and retract. The wrench 210 may include jaws movable between an open position and a closed position.

Figure 3A:
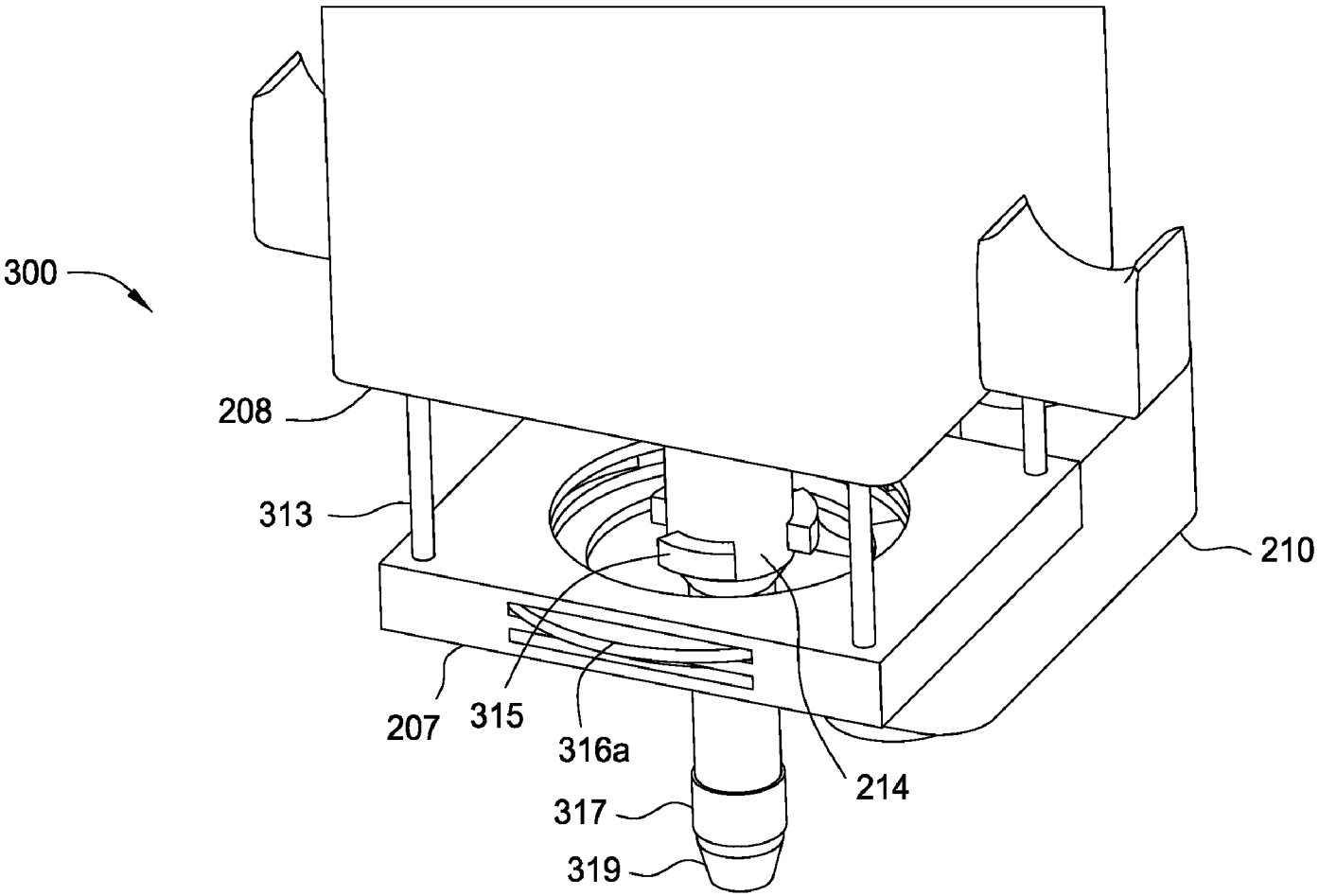
FIGS. 3A-3D illustrate the quick-connect system.
Figure 3B:
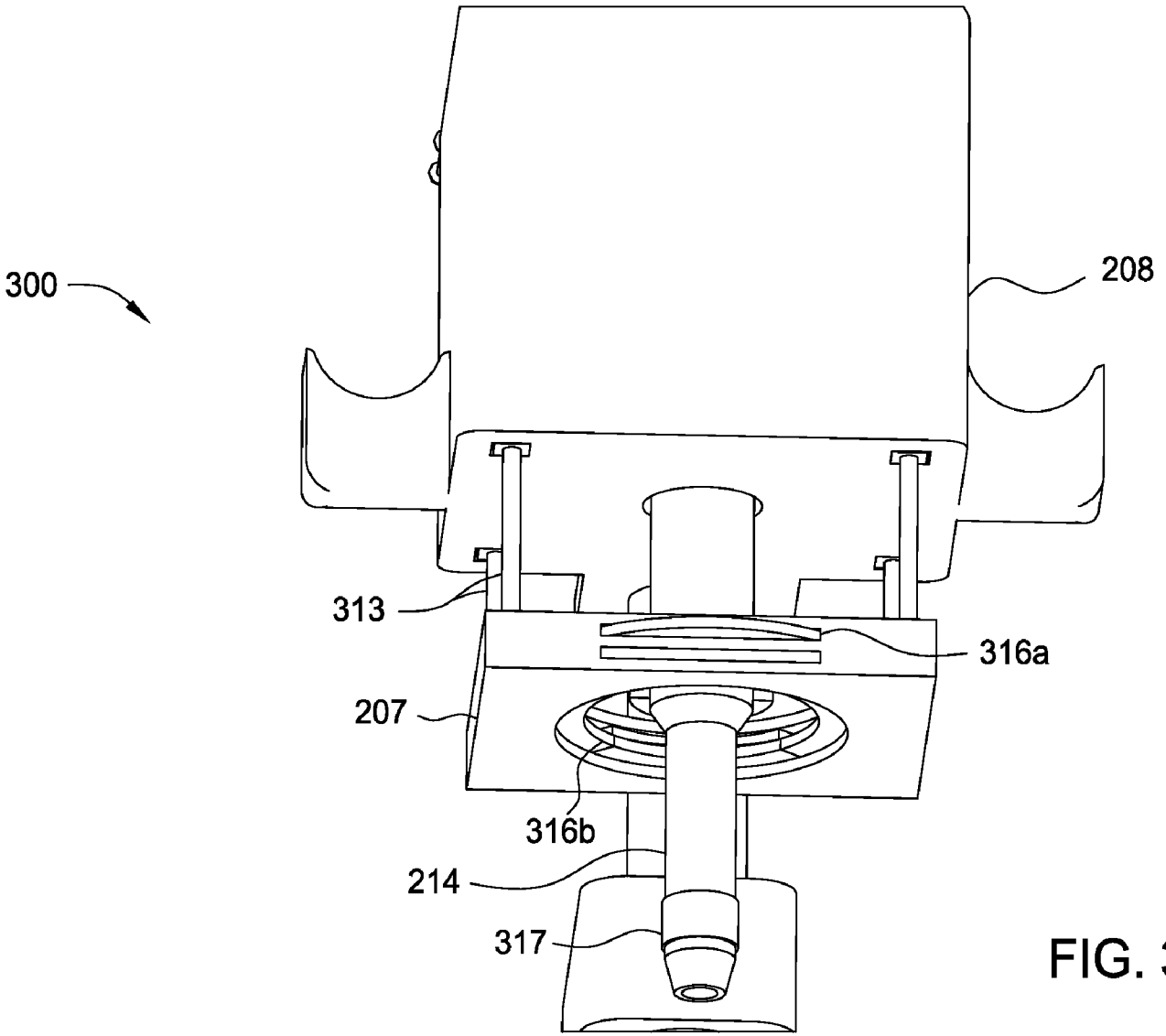
Figure 3C:
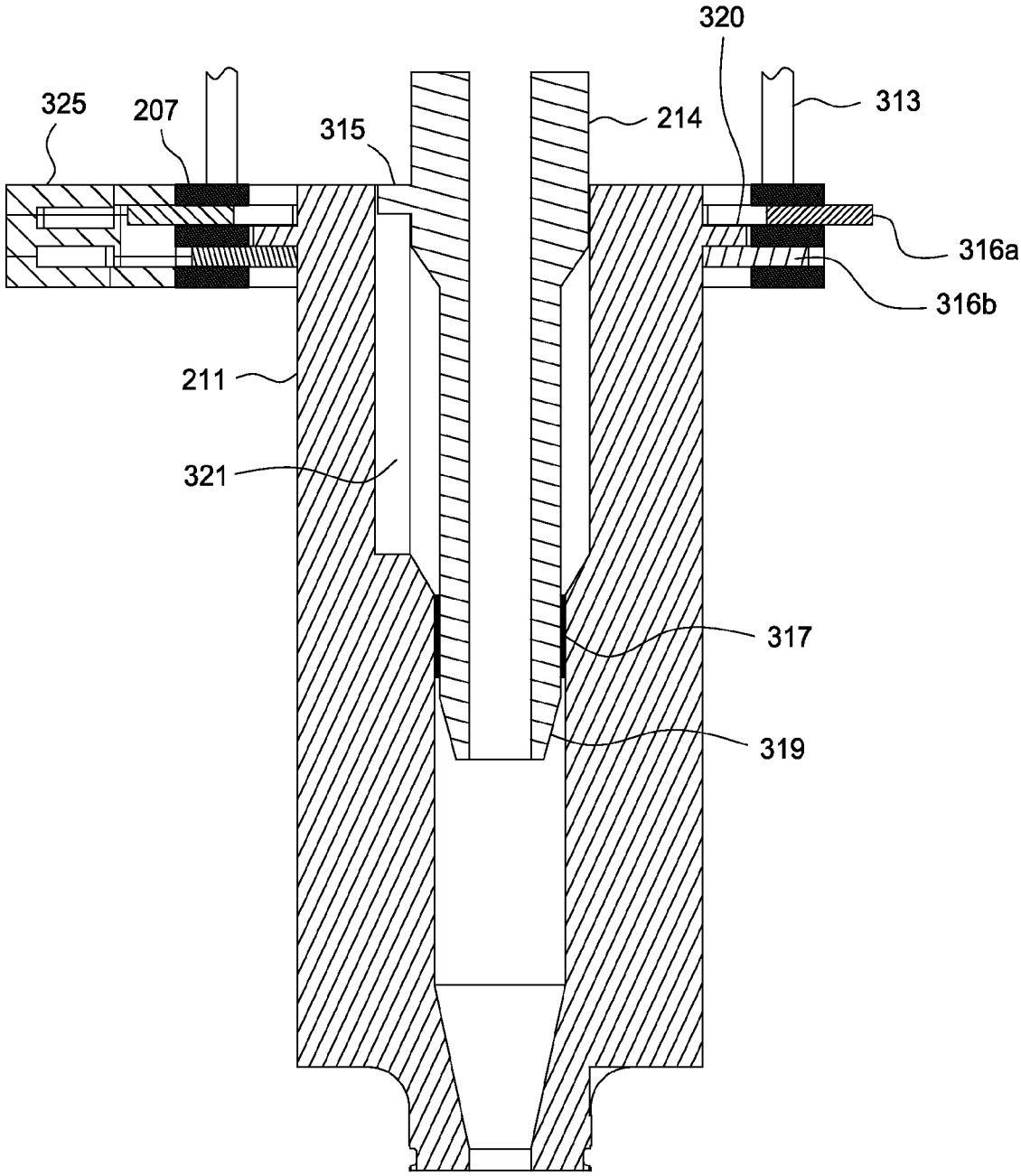
Figure 3D:
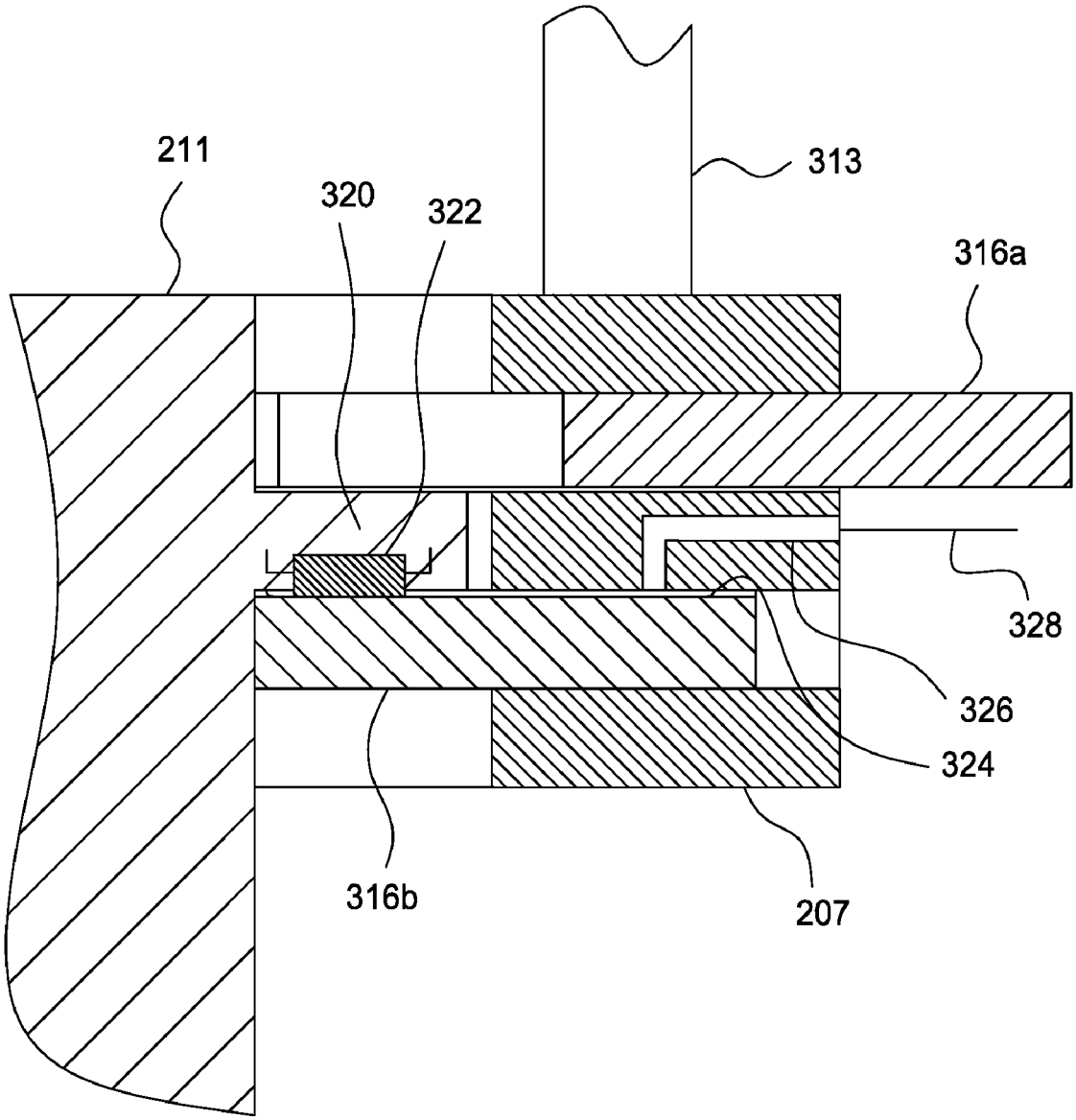

A lower end of the adapter 211 may be bidirectionally longitudinally and rotationally coupled to the drive shaft 222. The coupling may include male and female bayonet fittings (FIG. 3C, male) that simply insert into one another to provide sealed fluid communication and a locking ring to provide longitudinal and rotational coupling. Suitable locking rings are discussed and illustrated in FIGS. 11B and 11C of in U.S. Patent Application Publication Number US 2007/0131416, which is herein incorporated by reference in its entirety. Alternatively, a flanged coupling, the polygonal threaded coupling and lock ring illustrated in FIGS. 11 and 11A of the '416 publication, or the couplings discussed and illustrated with reference to FIGS. 6C and 6D or 7C and 7D, below, may be used instead. The drive shaft 222 may also be bidrectionally longitudinally and rotationally coupled to the torque sub 212 using any of these couplings. If the top drive assembly 250 includes drive shafts in addition to the quill 214, the additional drive shafts may be bidirectionally longitudinally and rotationally coupled to each other and/or the quill 214 using any of these couplings.

The manifold 215 may be longitudinally and rotationally coupled to the swivel 213 and connect hydraulic, electrical, and/or pneumatic conduits from the rig floor to casing elevator 216 and the torque head 212. The swivel 213 may provide fluid communication between non-rotating hydraulic and/or pneumatic conduits and the rotatable torque head 212 for operation thereof. The bracket 220 may be longitudinally and rotationally coupled to the manifold 213 for rotationally coupling the swivel 213 to the rail 30, thereby preventing rotation of the swivel 213 during rotation of the drive shaft 222, but allowing for longitudinal movement of the swivel 213 with the drive shaft 222 relative to the rail 30.

The casing link-tilt body 216 may be longitudinally and rotationally coupled to the swivel 213 and include the bails 225 and a link-tilt 217, such as a PCA, for pivoting the bails 225 and an elevator (not shown) to engage and hoist the casing 70 and aligning the casing 70 for engagement with the torque head 212. A pipe handling arm (not shown) connected to the rig may hold the casing 70 between disengagement from the bails and engagement with the torque head 212. The drive shaft 222 may be longitudinally and rotationally coupled to the torque head 212 using the bidirectional coupling discussed above. The circulation head 221 may engage an inner surface of the casing 70 for injection of drilling fluid into the casing. The circulation head 221 may be longitudinally coupled to the torque head 212 or the drive shaft 222.

FIGS. 3A-3D illustrate the quick-connect system 300. The quick connect system 300 may include the quill 214, a body 207, a quick-connect frame 209 (omitted for clarity, see FIG. 2), upper 316*a* and lower 316*b* loading plates, a compensator 313, and one or more actuators 325. Alternatively, an additional shaft longitudinally and rotationally coupled to the quill may be used instead of the quill 214. One or more prongs 315 may be formed on an outer surface of the quill 214. The prongs 315 may engage longitudinal splines 321 formed along an inner surface of the adaptor 211, thereby rotationally coupling the adaptor 211 and the quill 214 while allowing longitudinal movement therebetween during actuation of the compensator 313. A length of the splines 321 may correspond to a stroke length of the compensator 313. An end of the quill 214 may form a nozzle 319 for injection of drilling fluid into the casing string 80 during drilling or reaming with casing or a drill string during drilling operations. A seal 317 may be disposed around an outer surface of the quill 214 proximate to the nozzle for engaging a seal bore formed along an inner surface of the adapter 211. The seal bore may be extended for allowing longitudinal movement of the adapter 211 relative to the quill 214 during actuation of the compensator 313. The length of the seal bore may correspond to a stroke length of the compensator 313.

The compensator 313 may include one or more PCAs. Each PCA 313 may be pivoted to the link-tilt body 208 and the quick-connect body 207. The PCAs 313 may be pneumatically or hydraulically driven by conduits extending from the manifold 223. The compensator 313 may longitudinally support the quick-connect body 207 from the link-tilt body 208 during makeup of the casing 70. The quick-connect body 207 may also be rotationally coupled to the frame 209 so that the body 207 may move longitudinally relative to the frame 209 during actuation of the compensator 313. A fluid pressure may be maintained in the compensator 313 corresponding to the weight of the makeup assembly 275 and the weight of the casing 70 so that the casing 70 is maintained in a substantially neutral condition during makeup. A pressure regulator (not shown) may relieve fluid pressure from the compensator 313 as the joint is being madeup. Once the casing 70 is made up with the string 80, fluid pressure may be relieved from the compensator 313 so that the body 207 moves downward until the body 207 engages the frame 209. Resting the base on the frame 209 provides a more robust support so that the string 80 weight may be supported by the top drive assembly 250 instead of the compensator 313. The frame 209 may be longitudinally and rotationally coupled to the link-tilt body 208.

The quick-connect body 207 may include radial openings formed therethrough for receiving the plates 316 *a, b* and a longitudinal opening therethrough for receiving the adapter 211. The plates 316 *a, b* may be radially movable relative to the body 207 between an extended position and a retracted position by the actuators 325. Alternatively, the plates 316*a, b* may be manually operated. The body 207 may include two or more upper plates 316*a* and two or more lower plates 316*b*. Each set of plates 316*a, b* may be a portion of a circular plate having a circular opening formed at a center thereof corresponding to an outer surface of the adapter 211 so that when the plates 316*a, b* are moved to the extended position, the plates 316*a, b* form a circular plate having a circular opening. For example, the lower plates 316*b* may each be semi-circular having a semi-circular opening (or one-third-circular or quarter-circular (shown)). The adapter 211 may have a shoulder 320 extending from an outer surface thereof for engaging the plates 316*a, b*. In the retracted position, the plates 316*a, b* may be clear of the longitudinal opening, thereby allowing the adapter 211 to pass through the longitudinal opening. In the extended position, the plates 316*a, b* may engage the shoulder 320, thereby longitudinally coupling the base 207 to the adaptor 211.

The actuators 325 (only one shown) may electric, hydraulic, or pneumatic and may be longitudinally and rotationally coupled to the body 207 or formed integrally with the body 207. An additional actuator may be provided for each additional plate-portion. Each actuator 325 may include an upper and lower sub-actuator for respective upper 316*a* and lower plates 316*b*. Each sub-actuator may be independently operated so that the upper and lower plates may be independently operated. Conduits may extend to the actuators from the rig floor via the manifold 223.

One or more thrust bearings 322 may be disposed in a recess formed in a lower surface of the shoulder 320 and longitudinally coupled to the shoulder 320. The thrust bearings 322 may allow for the adapter 211 to rotate relative to the body 207 when the lower plates 316*b* are engaged with the shoulder 320. Grease may be packed into the recess for lubrication of the thrust bearings 322. Alternatively, a lubricant passage 326 may be formed through the body 207 and in fluid communication with a lubricant conduit 328 extending from the manifold 223 and a lubricant pump or pressurized reservoir located on the rig floor. A lubricant seal 324 may be disposed between the body and an upper surface of the lower plate 316*b* and between the shoulder and an upper surface of the lower plate 316*b* for retaining a liquid lubricant, such as oil, therebetween. One or more radial bearings may also be disposed between an inner surface of the lower plates 316*b* (and/or the upper plates 316*a*) and an outer surface of the adapter 211.

In operation, to connect the top drive assembly 250 to the makeup assembly 275 the top drive assembly 250 is lowered to the make up assembly until the nozzle 319 of the quill 214 enters the adapter 211. Lowering of the top drive assembly may continue until adapter is received in the body 207 bore and the prong 315 enters the spline 321. The quill 214 may be rotated to align the prong 315 between the splines 321. Lowering of the top drive assembly may continue until the shoulder 320 is substantially above the lower plates 316*b*. The actuators 325 may then be operated to move the lower plates to the extended position. The top drive assembly may then be raised, thereby picking up the makeup assembly 275. The actuators 325 may then be operated to move the upper plates 316*b* to the extended position.

Alternatively, the upper plates 316*a* may be omitted. Alternatively, the shoulder 320 may be replaced by a slot (not shown) for receiving one set of plates. Receiving the plates by a slot instead of the shoulder 320 allows bidirectional longitudinal coupling to be achieved with only one set of plates rather than two sets of plates.

Figure 4A:
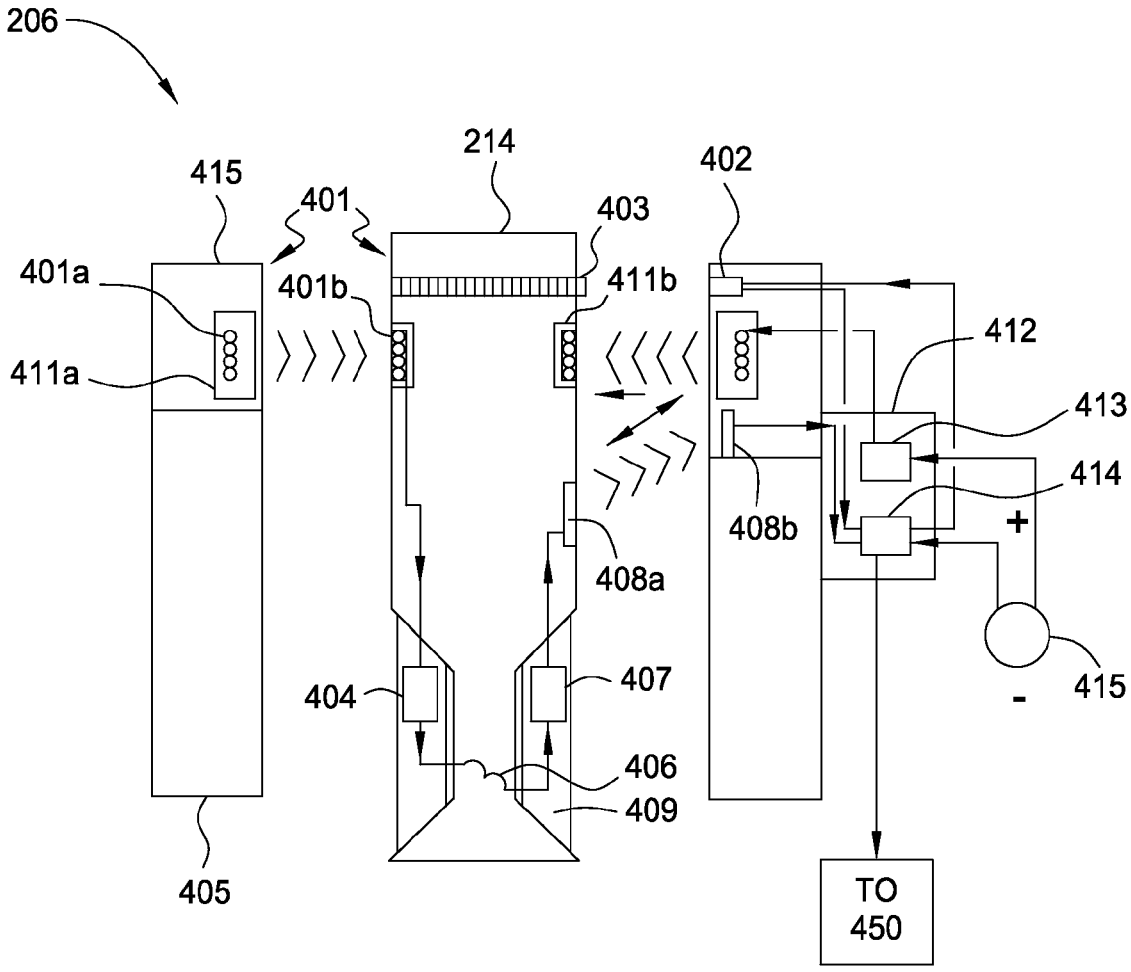
FIG. 4A illustrates the torque sub.

FIG. 4A illustrates the torque sub 206. The torque sub 206 may be connected to the top drive gearbox 204 for measuring a torque applied by the top drive 201. The torque sub may include a housing 405, the quill 214 or a torque shaft rotationally and longitudinally coupled to the quill, an interface 415, and a controller 412. The housing 405 may be a tubular member having a bore therethrough. The interface 415 and the controller 412 may both be mounted on the housing 405. The interface 415 may be made from a polymer. The quill 214 may extend through the bore of the housing 405. The quill 214 may include one or more longitudinal slots, a groove, a reduced diameter portion, a sleeve (not shown), and a polymer shield (not shown).

The groove may receive a secondary coil 401*b* which is wrapped therearound. Disposed on an outer surface of the reduced diameter portion may be one or more strain gages 406. Each strain gage 406 may be made of a thin foil grid and bonded to the tapered portion of the quill 214 by a polymer support, such as an epoxy glue. The foil strain gauges 406 may be made from metal, such as platinum, tungsten/nickel, or chromium. Four strain gages 406 may be arranged in a Wheatstone bridge configuration. The strain gages 406 may be disposed on the reduced diameter portion at a sufficient distance from either taper so that stress/strain transition effects at the tapers are fully dissipated. Strain gages 406 may be arranged to measure torque and longitudinal load on the quill 214. The slots may provide a path for wiring between the secondary coil 401*b* and the strain gages 406 and also house an antenna 408*a*.

The shield may be disposed proximate to the outer surface of the reduced diameter portion. The shield may be applied as a coating or thick film over strain gages 406. Disposed between the shield and the sleeve may be electronic components 404,407. The electronic components 404,407 may be encased in a polymer mold 409. The shield may absorb any forces that the mold 409 may otherwise exert on the strain gages 406 due to the hardening of the mold. The shield may also protect the delicate strain gages 406 from any chemicals present at the wellsite that may otherwise be inadvertently splattered on the strain gages 406. The sleeve may be disposed along the reduced diameter portion. A recess may be formed in each of the tapers to seat the shield. The sleeve forms a substantially continuous outside diameter of the quill 214 through the reduced diameter portion. The sleeve also has an injection port formed therethrough (not shown) for filling fluid mold material to encase the electronic components 404, 407.

A power source 415 may be provided in the form of a battery pack in the controller 412, an-onsite generator, utility lines, or other suitable power source. The power source 415 may be electrically coupled to a sine wave generator 413. The sine wave generator 413 may output a sine wave signal having a frequency less than nine kHz to avoid electromagnetic interference. The sine wave generator 413 may be in electrical communication with a primary coil 401*a* of an electrical power coupling 401.

The electrical power coupling 401 may be an inductive energy transfer device. Even though the coupling 401 transfers energy between the non-rotating interface 415 and the rotatable quill 214, the coupling 401 may be devoid of any mechanical contact between the interface 415 and the quill 214. In general, the coupling 401 may act similarly to a common transformer in that it employs electromagnetic induction to transfer electrical energy from one circuit, via its primary coil 401*a*, to another, via its secondary coil 401*b*, and does so without direct connection between circuits. The coupling 401 includes the secondary coil 401*b* mounted on the rotatable quill 214. The primary 401*a* and secondary 401*b* coils may be structurally decoupled from each other.

The primary coil 401*a* may be encased in a polymer 411*a*, such as epoxy. The secondary coil 401*b* may be wrapped around a coil housing 411*b* disposed in the groove. The coil housing 411*b* may be made from a polymer and may be assembled from two halves to facilitate insertion around the groove. The secondary coil 411*b* may then molded in the coil housing 411*b* with a polymer. The primary 401*a* and secondary coils 401*b* may be made from an electrically conductive material, such as copper, copper alloy, aluminum, or aluminum alloy. The primary 401*a* and/or secondary 401*b* coils may be jacketed with an insulating polymer. In operation, the alternating current (AC) signal generated by sine wave generator 412 is applied to the primary coil 401*a*. When the AC flows through the primary coil 401*a*, the resulting magnetic flux induces an AC signal across the secondary coil 401*b*. The induced voltage causes a current to flow to rectifier and direct current (DC) voltage regulator (DCRR) 404. A constant power is transmitted to the DCRR 404, even when the quill 214 is rotated by the top drive 201.

The DCRR 404 may convert the induced AC signal from the secondary coil 401*b* into a suitable DC signal for use by the other electrical components of the quill 214. In one embodiment, the DCRR outputs a first signal to the strain gages 406 and a second signal to an amplifier and microprocessor controller (AMC) 407. The first signal is split into sub-signals which flow across the strain gages 406, are then amplified by the amplifier 407, and are fed to the controller 407. The controller 407 converts the analog signals from the strain gages 406 into digital signals, multiplexes them into a data stream, and outputs the data stream to a modem associated with controller 407. The modem modulates the data stream for transmission from antenna 408*a*. The antenna 408*a* transmits the encoded data stream to an antenna 408*b* disposed in the interface 415. The antenna 408*b* sends the received data stream to a modem, which demodulates the data signal and outputs it to sub-controller 414.

The torque sub 206 may further include a turns counter 402, 403. The turns counter may include a turns gear 403 and a proximity sensor 402. The turns gear 403 may be rotationally coupled to the quill 214. The proximity sensor 402 may be disposed in the interface 415 for sensing movement of the gear 403. The sensor 402 may send an output signal to the makeup controller 450. Alternatively, a friction wheel/encoder device or a gear and pinion arrangement may be used to measure turns of the quill 214. The sub-controller 414 may process the data from the strain gages 406 and the proximity sensor 402 to calculate respective torque, longitudinal load, and turns values therefrom. For example, the sub-controller 414 may de-code the data stream from the strain gages 406, combine that data stream with the turns data, and re-format the data into a usable input (i.e., analog, field bus, or Ethernet) for a make-up system 450. Other suitable torque subs may be used instead of the torque sub 206.

Alternatively or additionally as a backup to the torque sub 206, the make-up control system 450 may calculate torque and rotation output of the top drive 50 by measuring voltage, current, and/or frequency (if AC top drive) of the power input to the top drive. For example, in a DC top drive, the speed is proportional to the voltage input and the torque is proportional to the current input. Due to internal losses of the top drive, the calculation is less accurate than measurements from the torque sub 600; however, the control system 450 may compensate the calculation using predetermined performance data of the top drive 50 or generalized top drive data or the uncompensated calculation may suffice. An analogous calculation may also be made for a hydraulic top drive (i.e., pressure and flow rate).

Figure 1A:
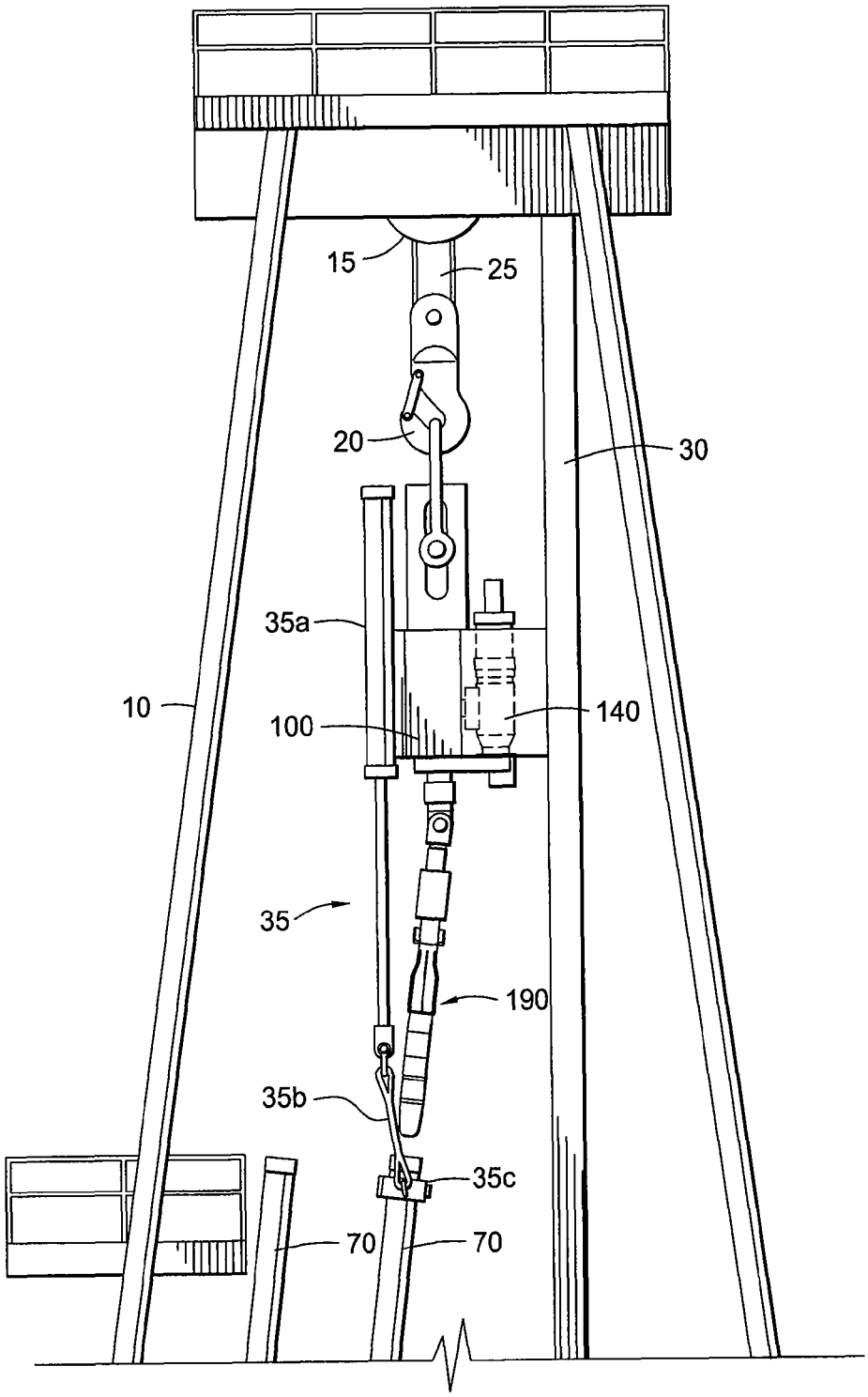
FIG. 1A (PRIOR ART)
FIGS. 1A-C illustrate a prior art casing makeup operation using a top drive.
Figure 1B:
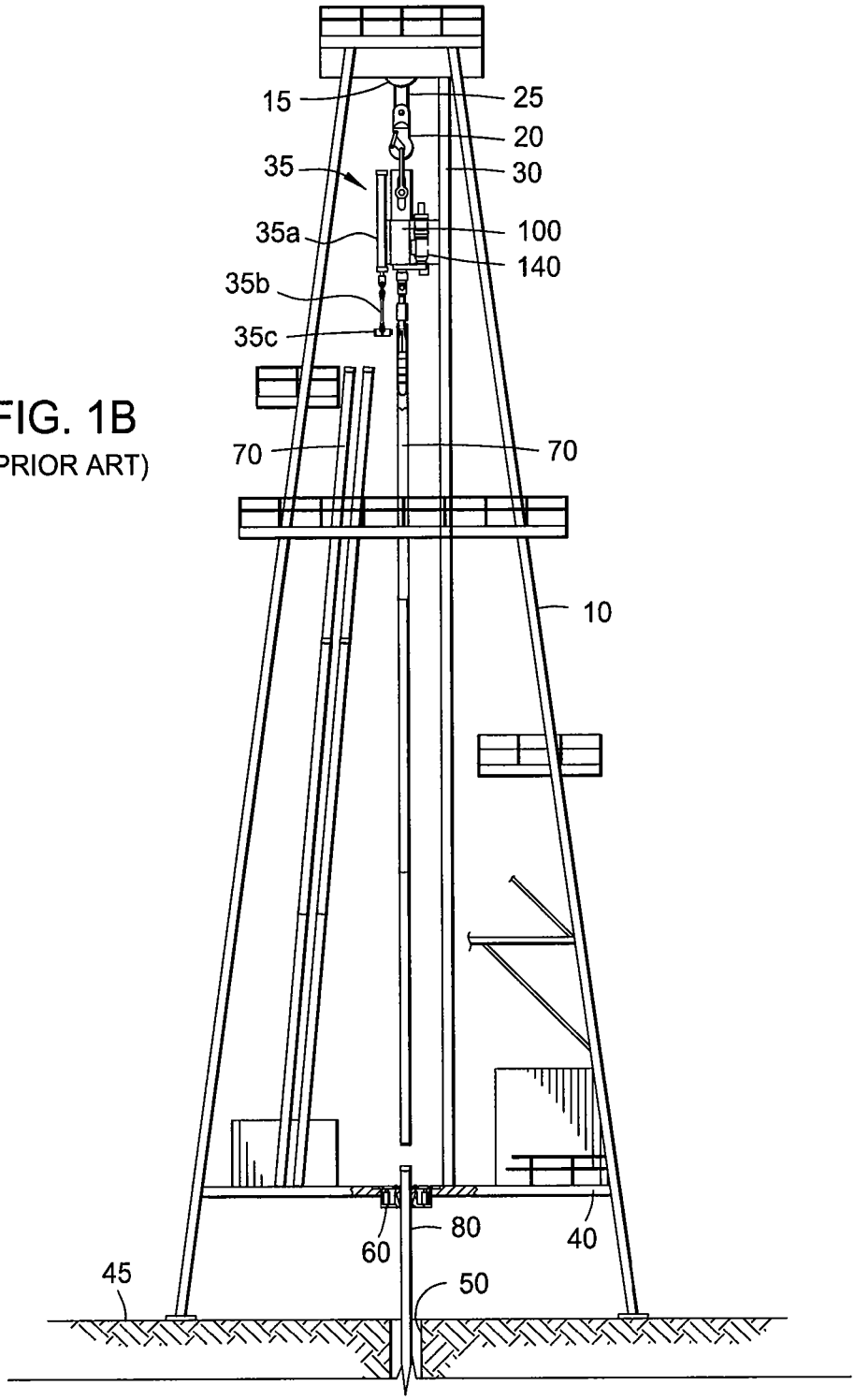
FIG. 1B (PRIOR ART)
Figure 1C:
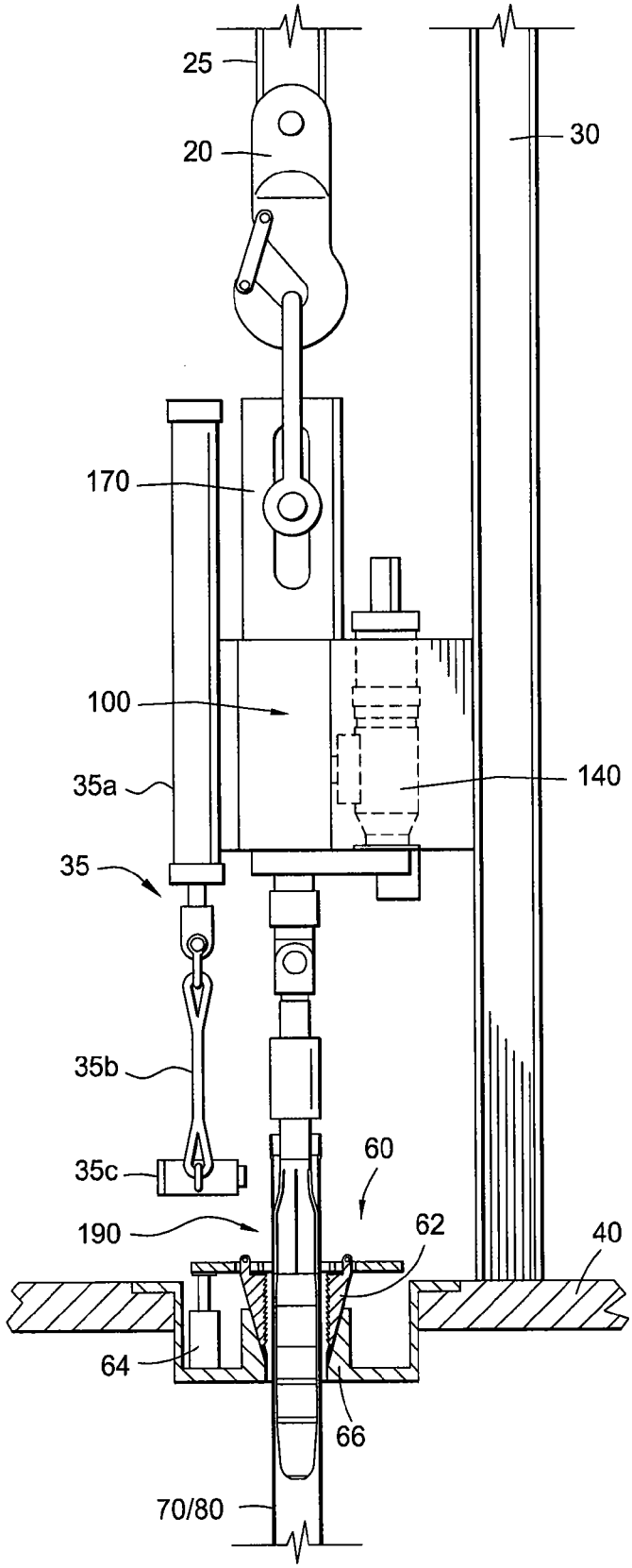
FIG. 1C (PRIOR ART)

Alternatively, the torque sub may be integrated with the makeup swivel 213. Alternatively, instead of the torque sub 206, strain gages or load cells may be disposed on the top drive rail bracket (see FIG. 1C) to measure reaction torque exerted by the top drive on the rail 201.

Figure 4B:
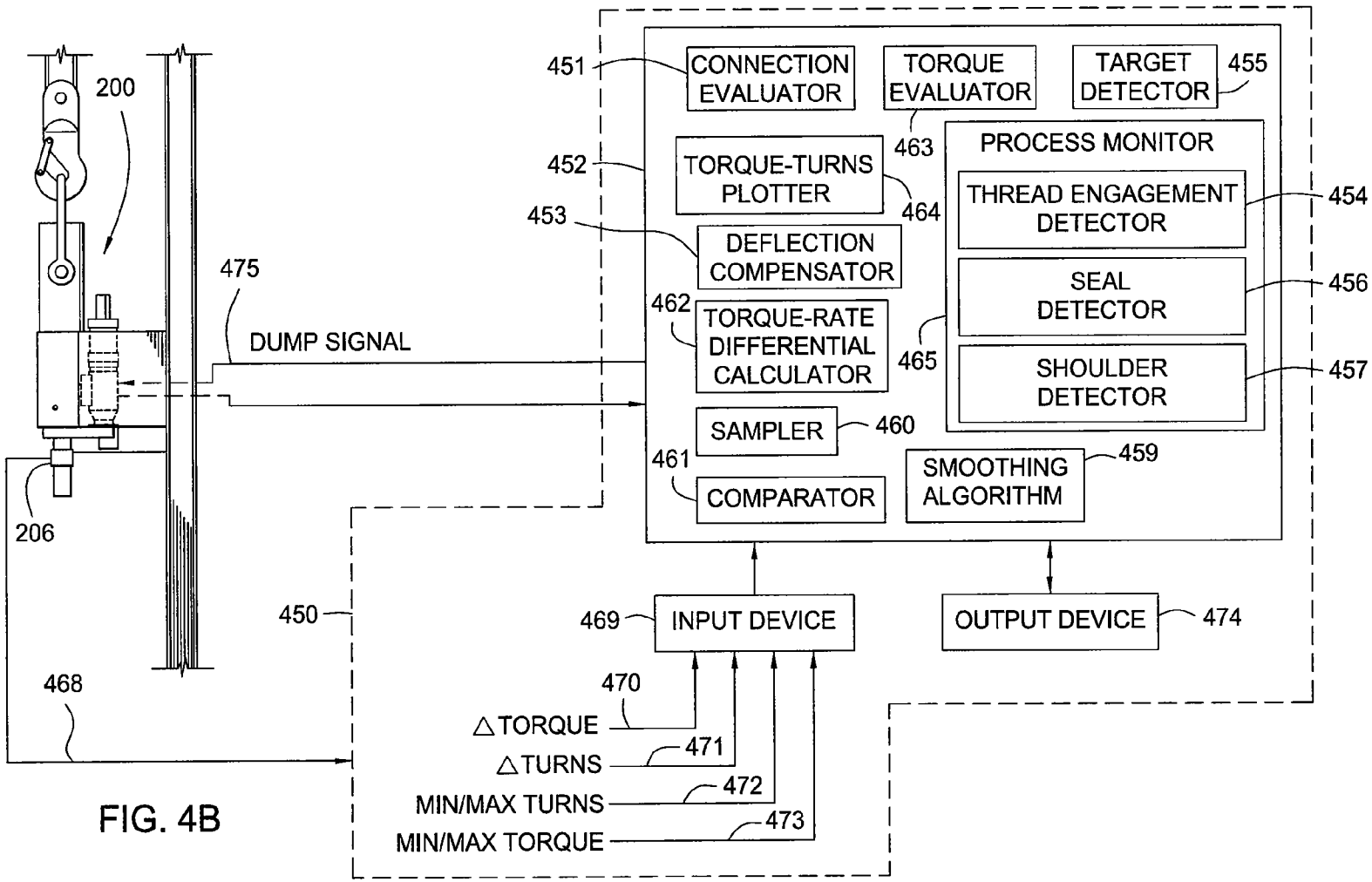
FIG. 4B illustrates a tubular make-up control system.

FIG. 4B illustrates a tubular make-up control system 450. During make-up of premium casing joints, a computer 452 of the control system 450 may monitor the turns count signals and torque signals 468 from the torque sub 206 and compares the measured values of these signals with predetermined values. Predetermined values may be input to the computer 452 via one or more input devices 469, such as a keypad. Illustrative predetermined values which may be input, by an operator or otherwise, include a delta torque value 470, a delta turns value 471, minimum and maximum turns values 472 and minimum and maximum torque values 473.

During makeup of casing joints, various output may be observed by an operator on output device, such as a display screen, which may be one of a plurality of output devices 474. The format and content of the displayed output may vary in different embodiments. By way of example, an operator may observe the various predefined values which have been input for a particular tubing connection. Further, the operator may observe graphical information such as a representation of a torque rate curve and the torque rate differential curve 500*a*. The plurality of output devices 474 may also include a printer such as a strip chart recorder or a digital printer, or a plotter, such as an x-y plotter, to provide a hard copy output. The plurality of output devices 474 may further include a horn or other audio equipment to alert the operator of significant events occurring during make-up, such as the shoulder condition, the terminal connection position and/or a bad connection.

Upon the occurrence of a predefined event(s), the control system 450 may output a dump signal 475 to automatically shut down the top drive 201. For example, dump signal 475 may be issued upon the terminal connection position and/or a bad connection. The comparison of measured turn count values and torque values with respect to predetermined values may be performed by one or more functional units of the computer 452. The functional units may generally be implemented as hardware, software or a combination thereof. In one embodiment, the functional units include a torque-turns plotter algorithm 464, a process monitor 465, a torque rate differential calculator 462, a smoothing algorithm 459, a sampler 460, a comparator 461, and a deflection compensator 453.

The frequency with which torque and rotation are measured may be specified by the sampler 460. The sampler 460 may be configurable, so that an operator may input a desired sampling frequency. The measured torque and rotation values may be stored as a paired set in a buffer area of computer memory. Further, the rate of change of torque with respect to rotation (i.e., a derivative) may be calculated for each paired set of measurements by the torque rate differential calculator 462. At least two measurements are needed before a rate of change calculation can be made. In one embodiment, the smoothing algorithm 459 operates to smooth the derivative curve (e.g., by way of a running average). These three values (torque, rotation, and rate of change of torque) may then be plotted by the plotter for display on the output device 474.

The rotation value may be corrected to account for system deflections using the deflection compensator 453. Since torque is applied to a casing 70 (e.g., casing) using the top drive 201, the top drive 201 may experience deflection which is inherently added to the rotation value provided by the turns gear 403 or other turn counting device. Further, the top drive unit 201 will generally apply the torque from the end of the casing 70 that is distal from the end that is being made up. Because the length of the casing joint or stand 70 may range from about 20 ft. to about 90 ft., deflection of the tubular may occur and will also be inherently added to the rotation value provided by the turns gear 403. For the sake of simplicity, these two deflections will collectively be referred to as system deflection. In some instances, the system deflection may cause an incorrect reading of the casing makeup process, which could result in a damaged connection.

To compensate for the system deflection, the deflection compensator 453 may utilize a measured torque value to reference a predefined value (or formula) to find (or calculate) the system deflection for the measured torque value. The deflection compensator 453 may include a database of predefined values or a formula derived therefrom for various torque and system deflections. These values (or formula) may be calculated theoretically or measured empirically. Empirical measurement may be accomplished by substituting a rigid member, e.g., a blank tubular, for the tubular and causing the top drive unit 50 to exert a range of torque corresponding to a range that would be exerted on the tubular to properly make-up a connection. The torque and rotation values measured may then be monitored and recorded in a database. The deflection of the tubular may also be added into the system deflection.

Alternatively, instead of using a blank for testing the top drive, the end of the tubular distal from the top drive unit 201 may simply be locked into the spider 60. The top drive 201 may then be operated across the desired torque range while the resulting torque and rotation values are measured and recorded. The measured rotation value is the rotational deflection of both the top drive unit 201 and the casing 70. Alternatively, the deflection compensator 453 may only include a formula or database of torques and deflections for the tubular. The theoretical formula for deflection of the tubular may be pre-programmed into the deflection compensator 453 for a separate calculation of the deflection of the tubular. Theoretical formulas for this deflection may be readily available to a person of ordinary skill in the art. The calculated torsional deflection may then be added to the top drive deflection to calculate the system deflection.

After the system deflection value is determined from the measured torque value, the deflection compensator 453 may then subtract the system deflection value from the measured rotation value to calculate a corrected rotation value. The three measured values—torque, rotation, and rate of change of torque—may then be compared by the comparator 461, either continuously or at selected rotational positions, with predetermined values. For example, the predetermined values may be minimum and maximum torque values and minimum and maximum turn values.

Based on the comparison of measured/calculated/corrected values with predefined values, the process monitor 465 may determine the occurrence of various events and whether to continue rotation or abort the makeup. In one embodiment, the process monitor 465 includes a thread engagement detection algorithm 454, a seal detection algorithm 456 and a shoulder detection algorithm 457. The thread engagement detection algorithm 454 monitors for thread engagement of the two threaded members. Upon detection of thread engagement a first marker is stored. The marker may be quantified, for example, by time, rotation, torque, a derivative of torque or time, or a combination of any such quantifications. During continued rotation, the seal detection algorithm 456 monitors for the seal condition. This may be accomplished by comparing the calculated derivative (rate of change of torque) with a predetermined threshold seal condition value. A second marker indicating the seal condition is stored when the seal condition is detected.

At this point, the turns value and torque value at the seal condition may be evaluated by the connection evaluator 451. For example, a determination may be made as to whether the corrected turns value and/or torque value are within specified limits. The specified limits may be predetermined, or based off of a value measured during makeup. If the connection evaluator 451 determines a bad connection, rotation may be terminated. Otherwise rotation continues and the shoulder detection algorithm 457 monitors for shoulder condition. This may be accomplished by comparing the calculated derivative (rate of change of torque) with a predetermined threshold shoulder condition value. When the shoulder condition is detected, a third marker indicating the shoulder condition is stored. The connection evaluator 451 may then determine whether the turns value and torque value at the shoulder condition are acceptable.

The connection evaluator 451 may determine whether the change in torque and rotation between these second and third markers are within a predetermined acceptable range. If the values, or the change in values, are not acceptable, the connection evaluator 451 indicates a bad connection. If, however, the values/change are/is acceptable, the torque evaluator 463 calculates a target torque value and/or target turns value. The target value is calculated by adding a predetermined delta value (torque or turns) to a measured reference value(s). The measured reference value may be the measured torque value or turns value corresponding to the detected shoulder condition. In one embodiment, a target torque value and a target turns value are calculated based off of the measured torque value and turns value, respectively, corresponding to the detected shoulder condition.

Upon continuing rotation, the target detector 455 monitors for the calculated target value(s). Once the target value is reached, rotation is terminated. In the event both a target torque value and a target turns value are used for a given makeup, rotation may continue upon reaching the first target or until reaching the second target, so long as both values (torque and turns) stay within an acceptable range. Alternatively, the deflection compensator 453 may not be activated until after the shoulder condition has been detected.

Whether a target value is based on torque, turns or a combination, the target values may not be predefined, i.e., known in advance of determining that the shoulder condition has been reached. In contrast, the delta torque and/or delta turns values, which are added to the corresponding torque/turn value as measured when the shoulder condition is reached, may be predetermined. In one embodiment, these predetermined values are empirically derived based on the geometry and characteristics of material (e.g., strength) of two threaded members being threaded together.

Figure 5A:
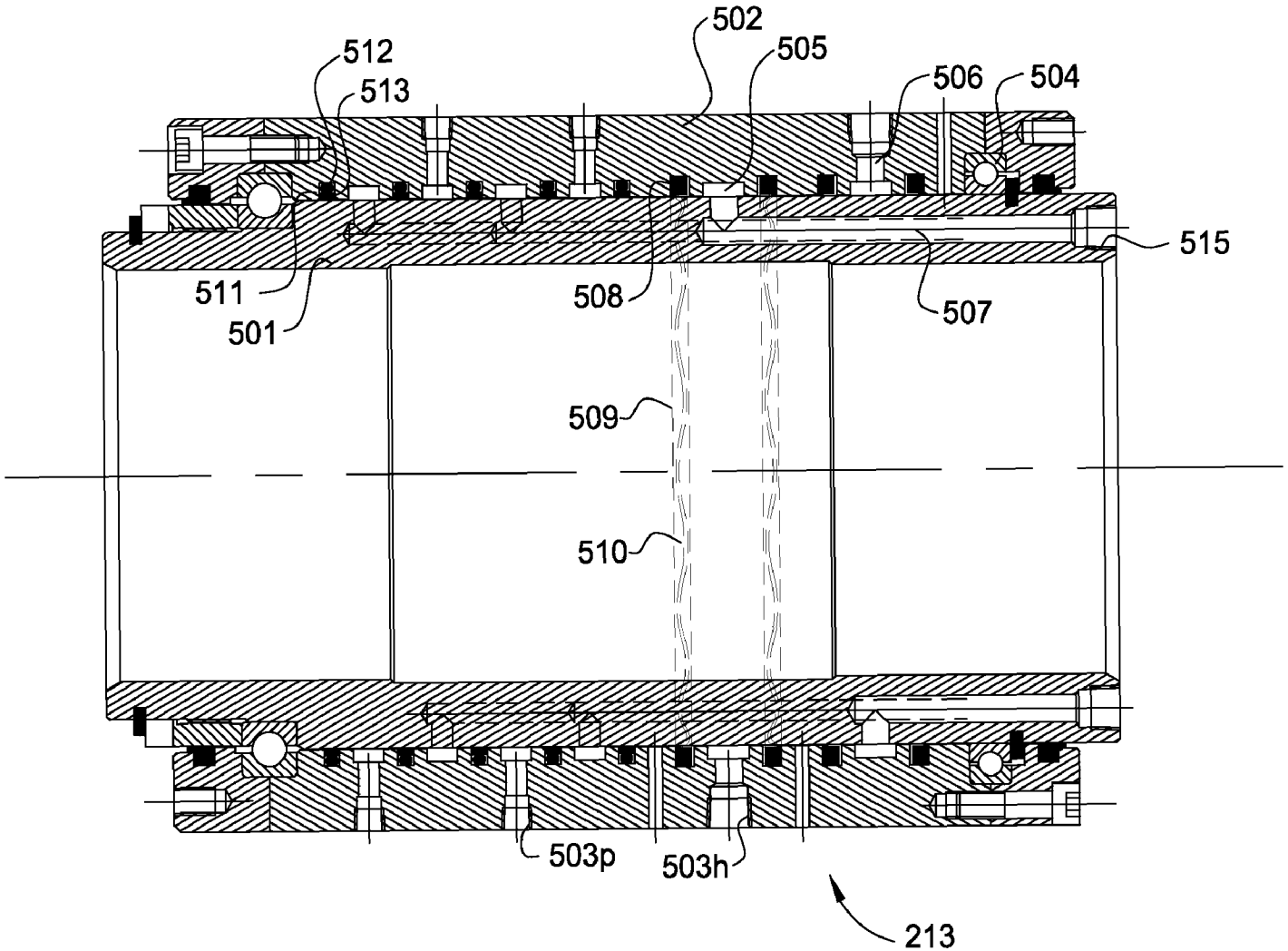
FIG. 5A illustrates the hydraulic swivel.

FIG. 5A illustrates the hydraulic swivel 213. The swivel 213 may include an inner rotational member 501 and an outer non-rotating member 502. The inner rotational member 501 may be disposed around and longitudinally and rotationally coupled to the drive shaft 222. The outer member 502 may fluidly couple one or more hydraulic and/or pneumatic control lines between the non-rotating manifold 215 and the torque head 212. The swivel 213 may include one or more hydraulic inlets 503*h* and one or more pneumatic inlets 503*p*. One or more bearings 504 may be included between the inner rotational member 501 and the outer member 502 in order to support the outer member 502.

The hydraulic fluid inlet 503*h* may be in fluid communication with an annular chamber 505 via a port 506 through the outer member 502. The annular chamber 505 may extend around the outer member 502. The annular chamber 505 may be in fluid communication with a control port 507 formed in a wall of the inner rotational member 501. The control port 507 may be in fluid communication with a hydraulic outlet 515. The hydraulic outlet 515 may be in fluid communication with the torque head 212.

In order to prevent leaking between the inner rotational member 501 and the outer member 502, a hydrodynamic seal 508 may be provided at a location in a recess 509 on each side of the annular chamber 505. The hydrodynamic seal 508 may be a high speed lubrication fin adapted to seal the increased pressures needed for the hydraulic fluid. The hydrodynamic seal 508 may be made of a polymer, such as an elastomer, such as rubber. The hydrodynamic seal 508 may have an irregular shape and/or position in the recess 509. The irregular shape and/or position of the hydrodynamic seal 508 in the recess 509 may create a cavity 510 or space between the walls of the recess 509 and the hydrodynamic seal 508. In operation, hydraulic fluid enters the annular chamber 505 and continues into the cavities 510 between the hydrodynamic seal 509 and the recess 509. The hydraulic fluid moves in the cavities as the inner rotational member 501 is rotated. This movement circulates the hydraulic fluid within the cavities 510 and drives the hydraulic fluid between the hydrodynamic seal contact surfaces. The circulation and driving of the hydraulic fluid creates a layer of hydraulic fluid between the surfaces of the hydrodynamic seal 508, the recess 509 and the inner rotational member 502. The layer of hydraulic fluid lubricates the hydrodynamic seal 508 in order to reduce heat generation and increase the life of the hydrodynamic seal. Each of the hydraulic inlets 503*h* may be isolated by hydrodynamic seals 508.

A seal 511 may be located between the inner rotational member 501 and the outer member 502 at a location in a recess on each side of the annular chamber of the pneumatic fluid inlets 503*p*. The seal 511 may include a standard seal 512, such as an O-ring, on one side of the recess and a low friction pad 513. The low friction pad may comprise a low friction polymer, such as polytetrafluoroethylene (PTFE) or Polyetheretherketone (PEEK). The low friction pad 513 reduces the friction on the standard seal 512 during rotation. Alternatively, the seal 512 and pad 513 may be used to isolate the hydraulic inlet 503*h* and/or the seal 508 may be used to isolate the pneumatic inlet 503*p*.

Figure 5B:
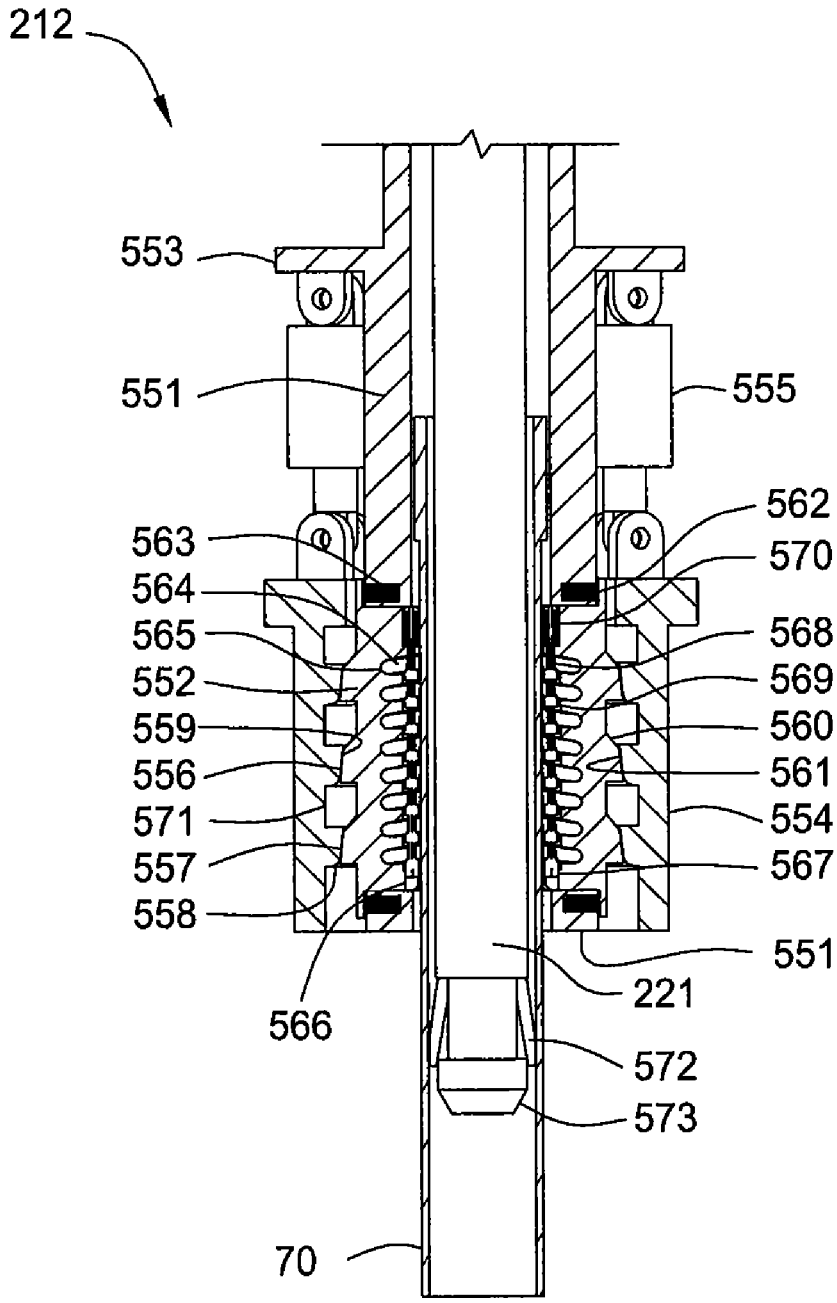
FIG. 5B illustrates the torque head.
Figure 6B:
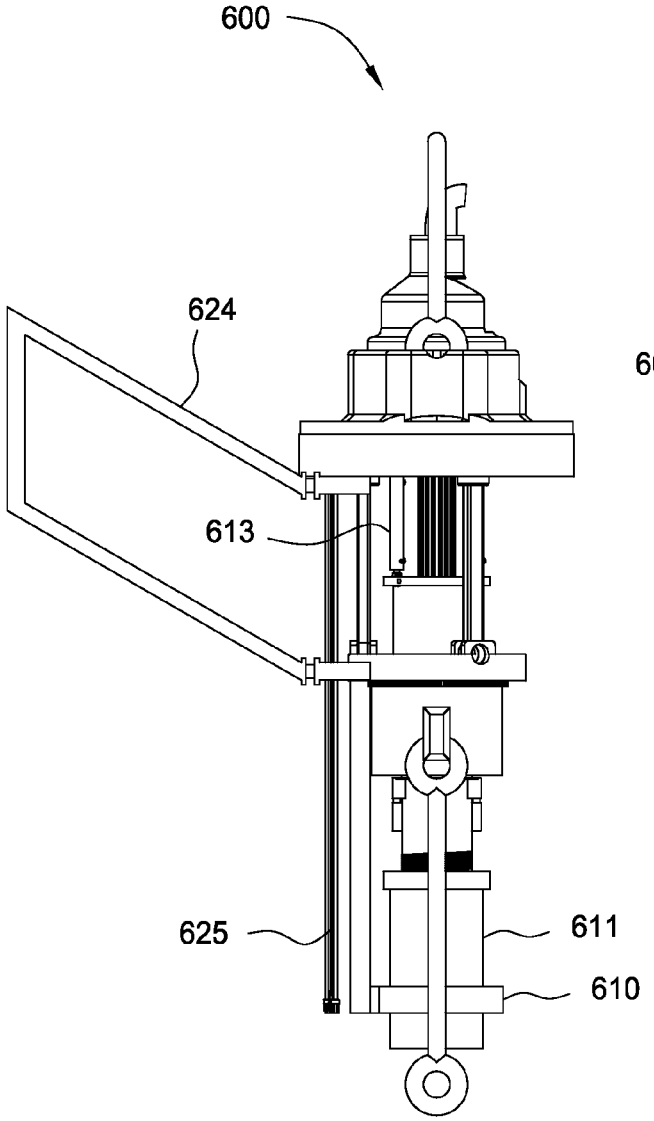
FIGS. 6A-6D illustrate a top drive assembly and quick connect system, according to another embodiment of the present invention.
Figure 6A:
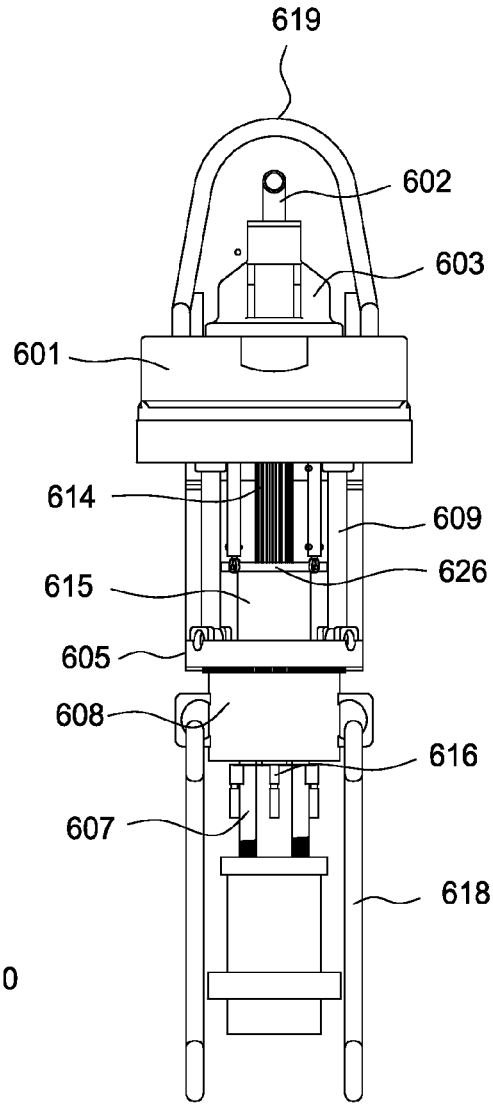
Figure 6C:
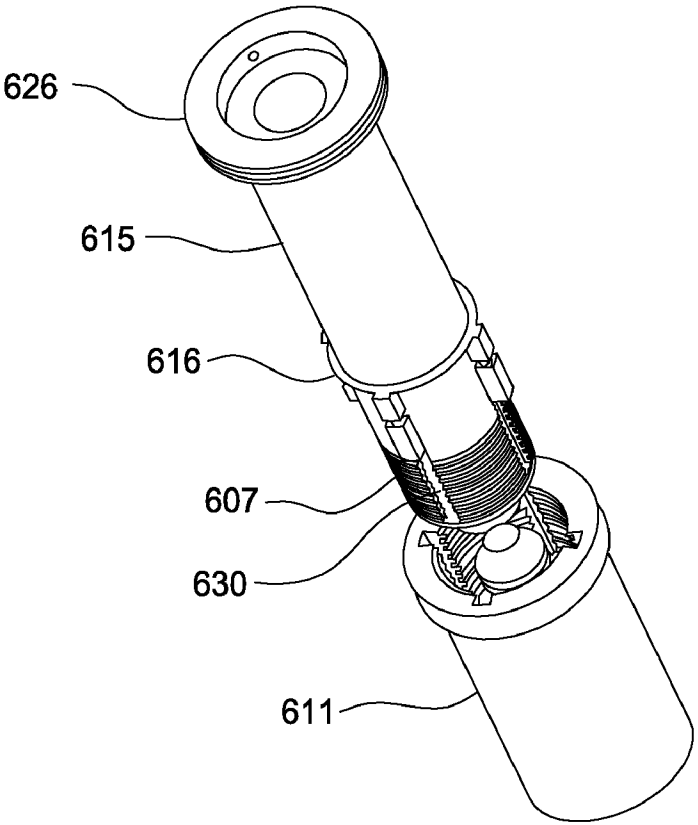
Figure 6D:
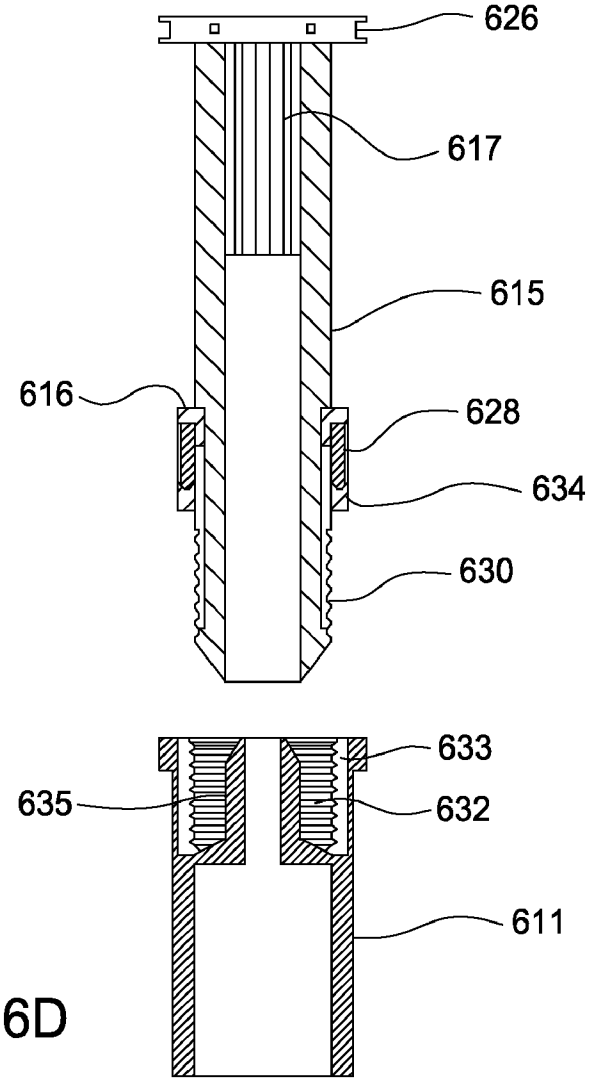
Figure 7B:
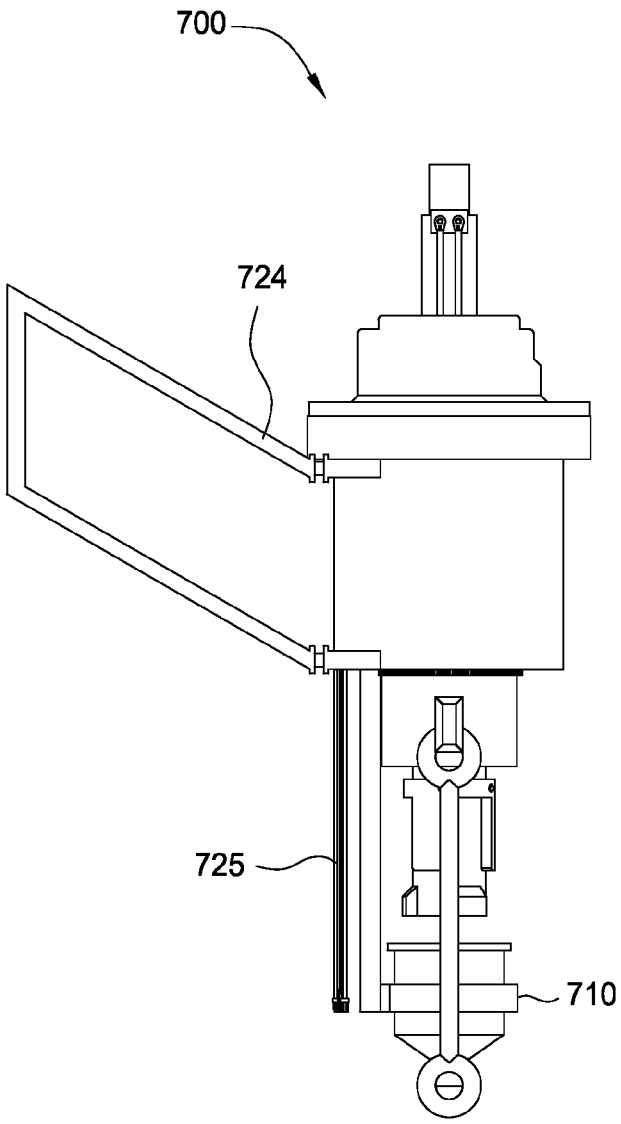
FIGS. 7A-7D illustrate a top drive assembly and quick connect system, according to another embodiment of the present invention.
Figure 7A:
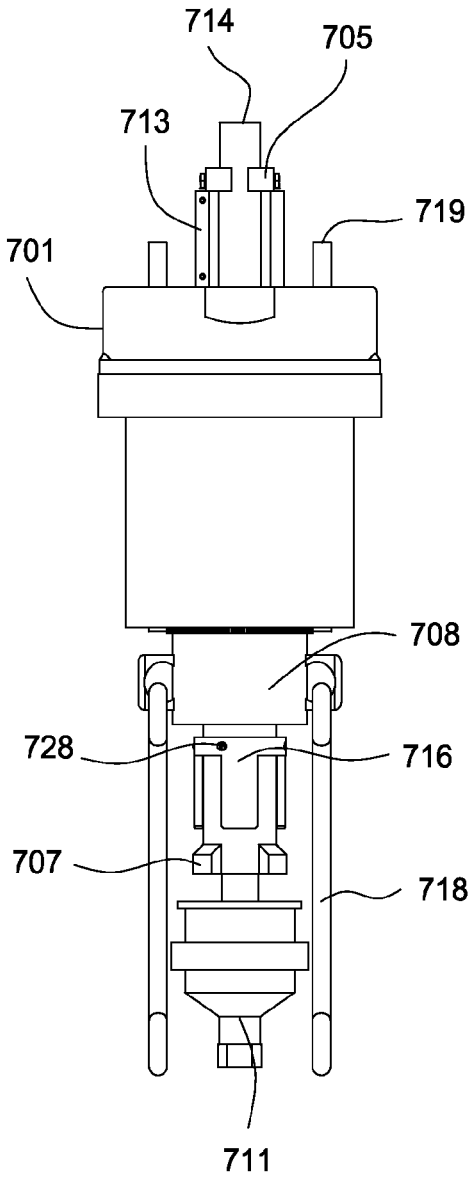
Figure 7C:
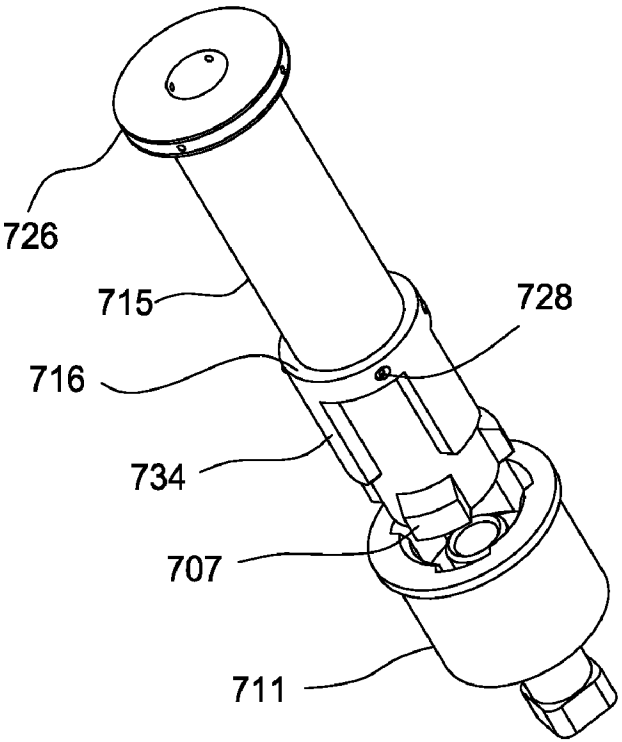
Figure 7D:
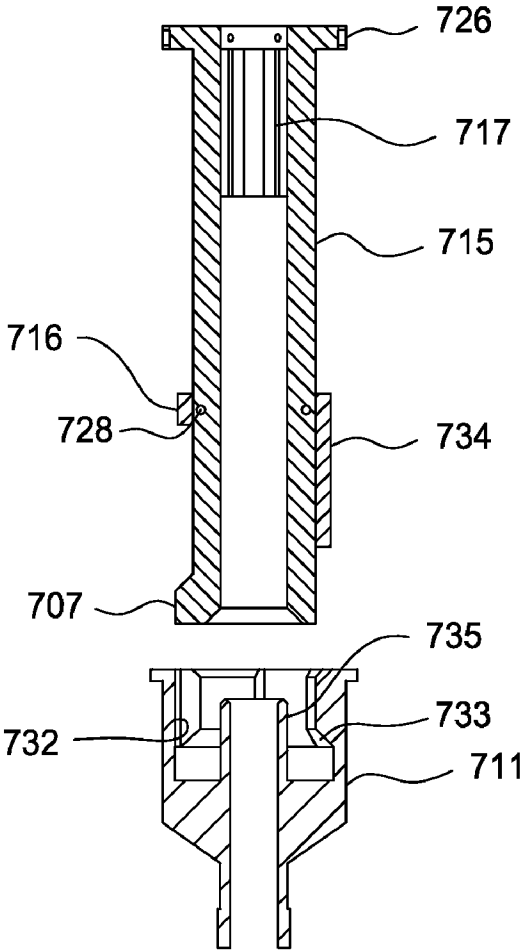

FIG. 5B illustrates the torque head 212. The torque head 212 may include a tubular body 551 longitudinally and rotationally coupled to the drive shaft 222. A lower portion of the body 551 may include one or more windows formed through a wall of the body 551. Each window may receive a gripping element 552. A flange 553 may extend from an outer surface of the body or be disposed on an outer surface of the body. A housing 554 may be disposed around the body 551. An actuator 555, such as one or more piston and cylinder assemblies (PCA), may be pivoted to the body 551 and the housing 554. The PCAs 555 may be hydraulically or pneumatically driven. Operation of the actuator 555 may raise or lower the housing 554 relative to the body 551. The interior of the housing 554 may include a key and groove configuration for interfacing with the gripping element 552. In one embodiment, the key 556 includes an inclined abutment surface 557 and an inclined lower surface 558. The transition between the lower surface 558 and the abutment surface 557 may be curved to facilitate lowering of the housing 554 relative to the body 551.

The gripping element 552 may have an exterior surface adapted to interface with the key and groove configuration of the housing 554. One or more keys 559 may be formed on the gripping element exterior surface and between the keys 559 may be grooves that accommodate the housing key 556. The gripping element keys 559 may each include an upper surface 560 and an abutment surface 561. The upper surface 560 may be inclined downward to facilitate movement of the housing keys 556. The abutment surface 561 may have an incline complementary to the housing abutment surface 557. Collars 562 may extend from the upper and lower ends of each gripping element 552. The collars 562 may each engage the outer surface of the body 551 to limit the inward radial movement of the gripping elements 552. A biasing member 563, such as a spring, may be disposed between each collar 562 and the body 551 to bias the gripping element 552 away from the body 551.

The interior surface of the gripping element 552 may include one or more engagement members 564. Each engagement member 564 may be disposed in a slot 565 formed in the interior surface of the gripping element 552. The engagement member 564 may be pivotable in the slot 565. The portion of the engagement member 564 disposed in the interior of the slot 565 may be arcuate in shape to facilitate the pivoting motion. The tubular contact surface each engagement member 564 may be smooth, rough, or have teeth formed thereon. The gripping element 552 may include a retracting mechanism to control movement of the engagement members 564. A longitudinal bore 566 may be formed adjacent the interior surface of each gripping element 552. An actuating rod 567 may be disposed in the bore 566 and through a recess 568 formed in each engagement member 564. The actuating rod 567 may include one or more supports 569 having an outer diameter larger than the recess 568. Each support 569 may be positioned on the actuating rod 567 at a level below each engagement member 564 such that each engagement member 564 rest on a respective support 569.

A biasing member 570, such as a spring, may be coupled to the actuating rod 567 and may be disposed at an upper end of the bore 566. The spring 570 may bias the actuating rod 567 toward an upward position where the engagement members 564 may be retracted. Movement of the actuating rod downward 567 may pivot the engagement members into an engaged position.

In operation, the casing 70 may be inserted into the body 551 of the torque head 212. At this point, the gripping element keys 559 may be disposed in respective grooves 571 in the housing 554. The actuating rod 567 may be in the upward position, thereby placing the engagement members 564 in the retracted position. As the casing 70 is inserted into the torque head 212, a box of the casing 70 may move across the gripping elements 552 and force the gripping elements 552 to move radially outward. After the box moves past the gripping elements 552, the biasing members 563 may bias the gripping elements 552 to maintain engagement with the casing 70.

Once the casing 70 is received in the torque head 212, the actuator 555 may be activated to lower the housing 554 relative to the body 551. Initially, the lower surface 558 of the housing 554 may encounter the upper surface 560 of the gripping elements 552. The incline of the upper and lower surfaces 560, 558 may facilitate the movement of the gripping elements 552 out of the groove 571 and the lowering of the housing 554. Additionally, the incline may also cause the gripping elements 552 to move radially to apply a gripping force on the casing 70. The gripping elements 552 may move radially in a direction substantially perpendicular to a longitudinal axis of the casing 70. The housing 204 may continue to be lowered until the abutment surfaces 561, 557 of the keys 559, 556 substantially engage each other. During the movement of the housing 554, the biasing members 563 between the collars 562 and the body 551 may be compressed. Additionally, the weight of the casing 70 may force the engagement members 564 to pivot slightly downward, which, in turn, may cause the actuating rod 567 to compress the biasing member 570. The casing 70 may now be longitudinally and rotationally coupled to the torque head 212.

The torque head is further discussed in U.S. Patent Application Publication No. 2005/0257933 which is herein incorporated by reference in its entirety. Alternatively, the torque head may include a bowl and slips instead of the housing and gripping members. Alternatively, a spear may be used instead of the torque head. A suitable spear is discussed and illustrated in the '416 Publication.

FIGS. 6A-6D illustrate a top drive assembly and quick connect system 600, according to another embodiment of the present invention. The system 600 may include a motor 601, a drilling fluid conduit connection 602, a hydraulic swivel 603, a drill pipe link-tilt body 608, support bails 609, a backup wrench 610, a quick connect adapter 611, compensator 613, a quill 614, a quick connect shaft 615, drill pipe bails 618, traveling block bail 619, a lock ring 616, a rail bracket 624, and a backbone 625.

The bail 619 may receive a hook of the traveling block 20, thereby longitudinally coupling the top drive assembly 600 to the traveling block 20. The top drive motor 601 may be electric or hydraulic. The rail bracket 624 may rotationally couple the motor 601 and the link-tilt body 608 to the rail 30 so that the assembly 600 may longitudinally move relative to the rail 30. The swivel 603 may provide fluid communication between the non-rotating drilling fluid connection 602 and the rotating quill 614 (or a swivel shaft rotationally and longitudinally coupled to the quill 614) for injection of drilling fluid from the rig mud pumps (not shown) through the makeup system 200, and into the casing 70. The swivel 603 may be longitudinally and rotationally coupled to the motor 601.

The system 600 may also include a manifold (not shown, see manifold 223) that may connect hydraulic, electrical, and/or pneumatic conduits from the rig floor to the motor 601 and compensator 613. The manifold may be longitudinally and rotationally coupled to the frame rail bracket 624. The backbone 625 may connect to the manifold and extend hydraulic, electrical, and/or pneumatic conduits, such as hoses or cables, from the manifold to the makeup assembly swivel 213, thereby eliminating need for the makeup manifold 215. The backbone 625 may also allow for the makeup controller to be integrated with the top drive controller, thereby saving valuable rig floor space.

The link-tilt body 608 may be longitudinally coupled to the motor 601 by support bails 609 pivoted to the motor 601 and a flange 605 of the link-tilt body 608. The link-tilt body 608 may include the bails 618, an elevator (not shown), and a link-tilt (not shown), such as a PCA, for pivoting the bails 618 and an elevator (not shown) to engage and hoist a joint or stand of drill pipe and aligning the drill pipe for engagement with the drill pipe adapter. The link-tilt body 608 may also include the backup wrench 610 that may be supported from the link-tilt body 608 by a shaft. The wrench 610 may hold the drill pipe between disengagement from the bails and engagement with the drill pipe adapter and hold the drill pipe while the top drive rotates the drill pipe adapter to make up the connection between the adapter and the drill pipe. The link-tilt body 608 may further include a motor (not shown) for rotating the wrench shaft one hundred eighty degrees so that the wrench may be moved into a position to grip drill pipe and then rotated out of the way for casing makeup operations. The wrench 610 may also be vertically movable relative to the link-tilt body 608 to move into position to grip the drill pipe and then hoisted out of the way for casing operations. The wrench 610 may also longitudinally extend and retract. The wrench may include jaws movable between an open position and a closed position.

Longitudinal splines may be formed on an outer surface of the quill 614. The quill splines may engage prongs or longitudinal splines 617 in or along an inner surface of the adaptor quick connect shaft 615, thereby rotationally coupling the shaft 615 and the quill 614 while allowing longitudinal movement therebetween during actuation of the compensator 613. A length of the quill splines may correspond to a stroke length of the compensator 313. An end of the quill 614 may form a nozzle (not shown, see nozzle 319) for injection of drilling fluid into the casing string 80 during drilling or reaming with casing or a drill string during drilling operations. A seal (not shown, see seal 317) may be disposed around an outer surface of the quill 614 proximate to the nozzle for engaging a seal bore formed along an inner surface of the shaft 615. The seal bore may be extended for allowing longitudinal movement of the shaft 615 relative to the quill 614 during actuation of the compensator 613. The length of the seal bore may correspond to a stroke length of the compensator 613.

The compensator 613 may include one or more PCAs. Each PCA 613 may be pivoted to a flange (not shown) of the quill 614 and a flange 626 of the shaft 615. The PCAs may be pneumatically or hydraulically driven by conduits extending from the manifold or the backbone 625 via a swivel (not shown). The compensator 613 may longitudinally support the shaft 615 from the quill 614 during makeup of the casing 70. A fluid pressure may be maintained in the compensator 613 corresponding to the weight of the makeup assembly 275 and the weight of the casing 70 so that the casing 70 is maintained in a substantially neutral condition during makeup. A pressure regulator (not shown) may relieve fluid pressure from the compensator 613 as the joint is being madeup. Once the casing 70 is made up with the string 80, fluid pressure may be relieved from the compensator 613 so that the shaft 615 moves downward until the shaft 615 engages the flange 605 of the link-tilt body 608. Resting the shaft 615 on the flange 605 provides a more robust support so that the string 80 weight may be supported by the motor 601 via the bails 609 instead of the compensator 613. One or more thrust bearings (not shown) may be disposed in a recess formed in a lower surface of the flange 626 and longitudinally coupled to the flange 626. The thrust bearings may allow for the shaft 615 to rotate relative to the flange 605 when the flange 626 is engaged with the flange 605.

The shaft 615 may have a thread 607 formed along an outer surface thereof and one or more longitudinal slots 630 formed along an outer surface at least partially, substantially, or entirely through the thread 607 and extending from the thread. The lock ring 616 may be disposed around an outer the outer surface of the shaft 615 so that the lock ring 616 is longitudinally moveable along the shaft between an unlocked position and a locked position. The lock ring 616 may include a block disposed in each slot 630. The lock ring 616 may include a key 634 longitudinally extending from each block. Each key 634 may be connected to a respective block via a load cell 628. The adapter 611 may include a thread 632 formed in an inner surface thereof corresponding to the shaft thread 607 and one or more longitudinal slots 633 formed along an inner surface extending through the thread 632.

To connect the shaft 615 to the adapter 611, the threads 607, 632 may be engaged and the shaft rotated relative to the adapter 611 until the threads are madeup. The adapter 611 may be held by the wrench 610 during makeup with the shaft 615. The shaft 615 may be slightly counter-rotated to align the lock ring keys 634 with the slots 633. The lock ring 616 may then be longitudinally moved downward until the keys 634 enter the slots 633, thereby bidirectionally rotationally coupling the shaft 615 to the adapter. The lock ring may be moved by an actuator (not shown), such as one or PCAs pivoted to the flange 626 and the lock ring 616. Alternatively, the lock ring may be manually operated.

Each block may engage only a respective slot 630 of the shaft 615 and each key 634 may engage only a respective slot of the adapter 611, thereby creating a cantilever effect across the load cell 628 when torque is transferred from the shaft 615 to the adapter 611. The load cell 628 may measure a resulting bending strain and transmit the measurement to a controller, analogous to the operation of the torque sub 206. Power may be similarly transmitted. Alternatively, the keys 634 may be formed integrally with the lock ring 616 and a strain gage may be disposed on an outer surface of each key 634 to measure the bending strain instead of using the load cell 628. Alternatively, the system 600 may include the torque sub 206. Alternatively, strain gages may be disposed on the rail bracket 624 for measuring reaction torque exerted on the rail 30.

The adapter 611 may further include a seal mandrel 635 formed along an inner portion thereof. The seal mandrel 635 may include a seal (not shown) disposed along an outer surface for engaging an inner surface of the shaft 615. At a lower end, the adapter 611 may include any of the bidirectional couplings for connection to the drive shaft 222, discussed above or a thread for connection to drill pipe. Alternatively, the shaft 615 and adapter 611 may be used with the top drive assembly 250 instead of the quick connect system 300.

Alternatively, instead of the lock ring 616, one or more spring-biased latches, such as dogs, may be longitudinally coupled to the shaft 615 at the top of or proximately above the threads 607. Proximately before the shaft threads 607 and the adapter threads 632 are fully madeup, each latch may enter the adapter and be compressed by the adapter threads. Makeup may continue until each latch is aligned with a respective slot 633, thereby allowing the latch to expand into the slot and completing the bidirectional coupling. The top drive/makeup controller may detect engagement of the latches with the slots by an increase in torque applied to the connection and then may terminate the connection. Alternatively, the quick connect system 300 may be used instead of the shaft 615 and adapter 611.

FIGS. 7A-7D illustrate a top drive assembly and quick connect system 700, according to another embodiment of the present invention. The system 700 may include a motor 701, a drill pipe link-tilt body 708, a backup wrench 710, a quick connect adapter 711, compensator 713, a quill 714, a quick connect shaft 715, drill pipe bails 718, a lock ring 716, lugs 719, and a rail bracket 724, and a backbone 725.

As compared to the system 600, the drilling fluid conduit connection 602 and the hydraulic swivel 603 may be integrated into the traveling block (not shown). The quill 714 may then connect to a swivel shaft (not shown) extending from the integrated traveling block using a bidirectional coupling, discussed above. Each PCA of the compensator 713 may be pivoted to a flange 705 of the quill 714 and pivoted to a flange 726 of the quick connect shaft 715. The shaft 715 and the quill 714 may be rotationally coupled while allowing relative longitudinal movement therebetween by longitudinal splines 717 (only shaft splines shown). Once the casing 70 connection is made up to the string 80, the compensator 713 may be relieved and the flange 726 may rest on a loading plate (not shown) disposed in the motor 701 and longitudinally coupled to the integrated block swivel via bails (not shown) pivoted to the integrated block swivel and the motor 701 via lugs 719.

The shaft 715 may include one or more prongs 707 extending from an outer surface thereof. The lock ring 716 may be disposed around an outer the outer surface of the shaft 715 so that the lock ring 716 is longitudinally moveable along the shaft between an unlocked position and a locked position. The lock ring 716 may include a key 734 for each prong 707. The adapter 711 may include a longitudinal spline 732 for longitudinally receiving a respective prong 707 and a shoulder 733 for engaging a respective prong 707 once the prong 707 has been inserted into the spline 732 and rotated relative to the adapter 711 until the prong 707 engages the shoulder 733. Once each prong 707 has engaged the respective shoulder 733, the lock ring 716 may be moved into the locked position, thereby engaging each key 734 with a respective spline 732. The shaft 715 may include one or more holes laterally formed through a wall thereof, each hole corresponding to respective set of holes formed through the lock ring 716. Engaging the keys 734 with the spline 732 may align the holes for receiving a respective pin 728, thereby bidrectionally rotationally and longitudinally coupling the shaft 715 to the adapter 711. The pins 728 may be load cells or have a strain gage disposed on an outer surface thereof. Alternatively, the lock ring 716 may have a key formed on an inner surface thereof for engaging a longitudinal spline formed in the outer surface of the shaft 715 so that the lock ring 716 may be operated by an actuator (not shown), such as one or more PCAs, pivoted to the flange 726 and the lock ring 716.

The adapter 711 may further include a seal mandrel 735 extending along an inner portion thereof. The seal mandrel 735 may include a seal (not shown) disposed along an outer surface for engaging an inner surface of the shaft 615. At a lower end, the adapter 711 may include any of the bidrectional couplings for connection to the drive shaft 222, discussed above or a thread for connection to drill pipe. Alternatively, the shaft 715 and adapter 711 may be used with the top drive assembly 250 instead of the quick connect system 300 or with the top drive assembly 600 instead of the shaft 615 and the adapter 611. Alternatively, the quick connect system 300 may be used instead of the shaft 715 and adapter 711.

Figure 8A:
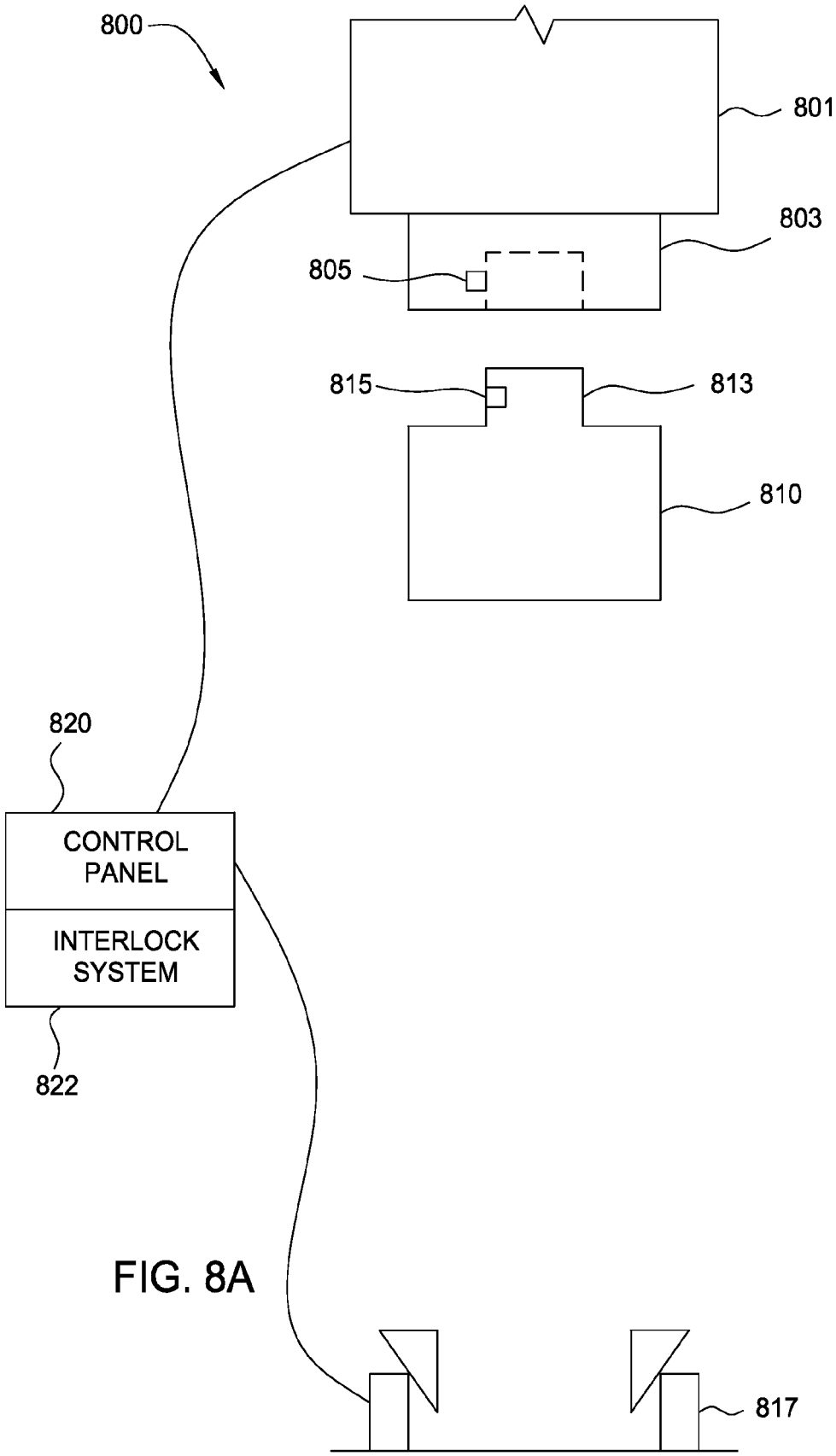
FIG. 8A illustrates a top drive casing makeup system, according to another embodiment of the present invention.

FIG. 8A illustrates a top drive casing makeup system 800, according to another embodiment of the present invention. The system 800 may include a top drive 801, a quick connect system 803, 813, a casing makeup tool 810, and a control panel 820. The quick connect system 803, 813 may be bidirectional, such as the quick connect system 300, or conventional threaded couplings. The top drive 801 may be provided with the integrated control system 820 to control one or more tools connected thereto, for example, the top drive casing makeup tool 810. A shaft 803 of the quick connect system may be provided with a control connection 805 that connects to a control connection 815 on the adapter 813 of the quick connect system upon connection of the casing makeup tool 810 to the top drive 801. The control connections 805, 815 may be electric, hydraulic, and/or pneumatic. The controls of the makeup tool 810 may be connected with the controls of the top drive 801, thereby allowing the makeup tool 810 to be operated from the same control panel 820 used to control the top drive 801.

Additionally, two or more tools connected in series may each include the control connections 805, 815 so that both tools may be operated from the control panel 820. For example, the drive shaft 222 may connect to the adapter 813 using the control connections 805, 815 for operation of the elevator 216 (via the swivel 213) and the torque head body 551 may connect to the drive shaft 222 using the control connections 805, 815 for operation of the torque head 212. The control lines from the control panel may be connected to the non-rotating manifold 223. Electric and/or data signals may be sent to the rotating control connection 805 via inductive couplings, such as inductive couplings 411*a, b* and/or RF antennas 408*a, b* disposed in the torque sub 206. A swivel, similar to the swivel 213, may be incorporated in the torque sub 206 for fluid communication between the non-rotating manifold 223 and the control connection 805. One or more longitudinal passages may be formed through a wall of the quill 214 to connect the torque sub swivel to the connection 805 and one or more longitudinal passages may be formed through the wall of the drive shaft 222 to connect the connection 815 to the swivel 213 and/or torque head 212. Alternatively, one or more conduits may be disposed along outer surfaces of the quill 214 and the drive shaft or along the bores thereof.

The control connections 805, 815 may connect and communicate upon connection of the shaft 805 to the adapter 813. Alternatively, the control connections 805, 815 may be manually connected after (or before) connection of the shaft 805 to the adapter 813. The control panel 820 may include, or be connected to an interlock system 822 for spider 817 and the makeup tool 810. The interlock system 822 may ensure that at least one of the spider 817 and the makeup tool 310 is retaining the casing 70, thereby preventing the inadvertent release of the casing 70. The interlock system 822 may prevent the control panel 820 from opening the spider 817 or the makeup tool 810 when the other tool is not retaining the casing 70. For example, if the casing 70 is not retained by the spider 817, the interlock system 822 prevents the control panel 820 from opening makeup tool 810.

Figure 8B:
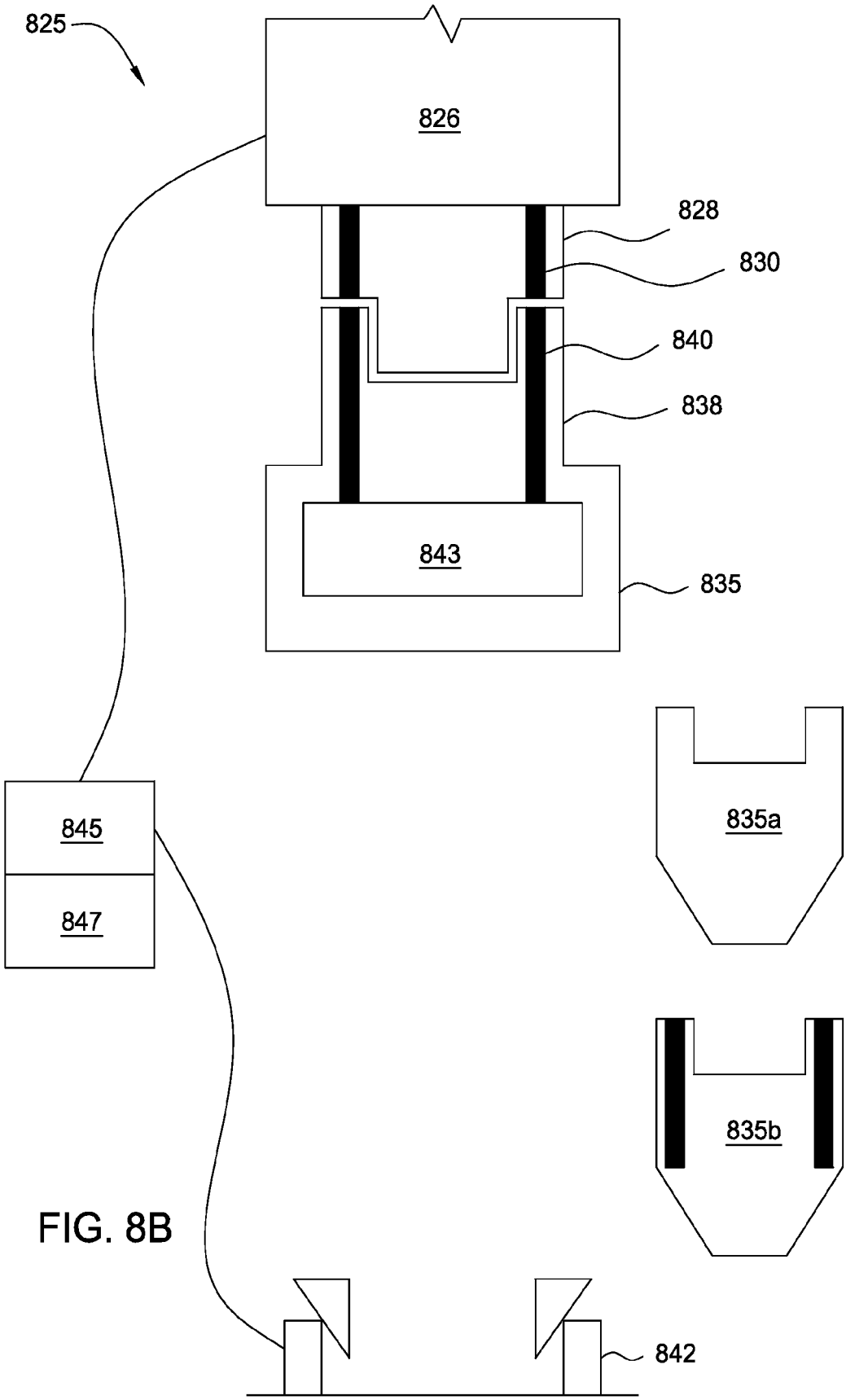
FIG. 8B illustrates a top drive casing makeup system, according to another embodiment of the present invention.

FIG. 8B illustrates a top drive casing makeup system 825, according to another embodiment of the present invention. The system 825 may include a top drive 826, a quick connect system 828, 838, a casing makeup tool 835, and a control panel 845. The quick connect system 828, 838 may be bidirectional, such as the quick connect system 300, or conventional threaded couplings. The top drive 826 may be provided with the integrated control system 845 to control one or more tools connected thereto, for example, the top drive casing makeup tool 835. A shaft 828 of the quick connect system may include a feed-through 830 in communication with a feed-through 840 of the adapter 838, when the top drive 826 is connected to the makeup tool 835. Instead of the make-up adapter 838, a drill pipe adapter 835*a*, a drill pipe adapter 835*b* equipped with a feed-through for connection to wired drill pipe, a link tilt device, a swivel, and any other tool suitable for connection to the top drive may be used.

The feed-throughs 830, 840 may transmit, including sending or receiving, power, control instructions, and/or data between the top drive 826 and the makeup tool 835 and may be electric, hydraulic, and/or pneumatic. For example, the feed-through 840 may be connected to one or more sensors of a gripping element of the makeup tool 835 such that the position, i.e. engaged or disengaged, of the gripping element may be transmitted to the control panel 845. The data from the sensor may be used by the interlock system 847 to determine if the spider 842 can be disengaged from the casing 70. The feed-throughs 830, 840 may also be used to communicate control instructions between the control panel 845 and the control systems the makeup tool 835. The feed-throughs 830 may receive electricity and/or data signals from the non-rotating manifold via inductive couplings and/or RF antennas and/or fluid pressure from a swivel. The system 825 may further include a sensor to monitor and indicate the status of the quick connect system 830, 840.

Figure 8C:
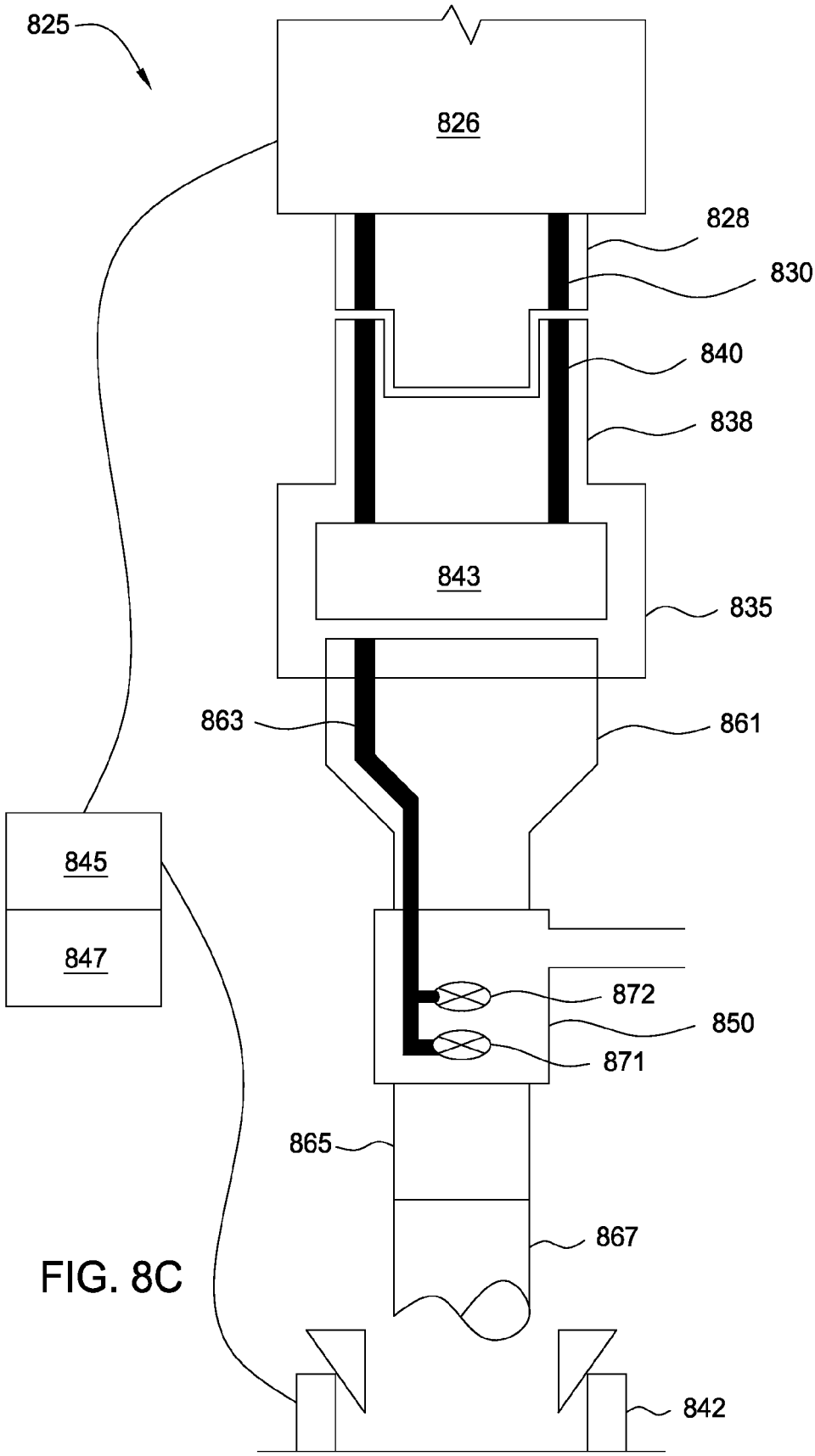
FIG. 8C illustrates a cementing tool connected to the top drive casing makeup system, according to another embodiment of the present invention.

FIG. 8C illustrates a cementing tool 850 connected to the top drive casing makeup system 825, according to another embodiment of the present invention. The cementing tool 850 may include a first connector 861 for connection to the makeup tool 835 and a second connector 865 for connection. Both the top drive 826 and the 850 cementing tool 850 may be operated by the control panel 845 after connection to the top drive 826. The cementing tool 850 may also include a first control 871 for releasing a first device (such as a plug, dart, or ball) and a second control 872 for releasing a second device. The first and second controls 871, 872 may be connected to a feed-through 863 that can connect to the feed-through 840. The control panel 845 may be used to operate the first and second controls 871, 872 to release the first and second actuators at the appropriate time. Alternatively, the cementing tool 850 may connect directly to the shaft 828 of the quick connect system, thereby omitting the makeup tool 835, using a cementing adapter (not shown) or the drill pipe adapter 835*b*.

The control couplings 805, 815 or feed-throughs 830, 840 provide for connection of the top drives 801, 826 to a variety of different tools in a modular fashion. The modular connections allow integration of the various tools with the top drive control system 820, 845 without requiring additional control systems and/or service loops (i.e., manifolds, swivels, etc.) Further, when using the control couplings or feed-throughs with the quick-connect bidirectional couplings, the risk of unintentionally backing-out a connection is eliminated.

Any of the quick connect systems 300, 500, 600 may include the control couplings 805, 815 or the feed-throughs 830, 840.

The casing makeup systems 200, 500, 600, 800, and 825 may be used to run casing 80 into a wellbore to line a previously drilled section of wellbore. The casing 80 may be reamed into the wellbore by inclusion of a drillable reamer shoe connected to a bottom of the casing string 80. The systems 200, 500, 600, 800, and 825 may also be used to drill with casing. To drill with casing, the casing string 80 may include a retrievable drill bit latched to a bottom of the casing string or a drillable drill bit connected to a bottom of the casing string 80. The drill bit may be rotated by rotating the casing string or by a mud motor latched to the casing string. The casing string may be drilled into the earth, thereby forming the wellbore and simultaneously lining the wellbore. The casing string may then be cemented in place. Additionally, any of the systems 200, 500, 600, 800, and 825 may be used to run/ream a liner string into a pre-drilled wellbore or to drill with liner.

Any of the bidirectional rotational couplings between the quill and the adaptors discussed herein may be replaced by any type of rotational coupling allowing longitudinal movement therebetween, such as polygonal profiles (i.e., square or hexagonal).

As used herein, control lines or conduits may conduct or transmit power, control signals, and/or data in any form, such as electrically, hydraulically, or pneumatically.

While the foregoing is directed to embodiments of the present invention, other and further embodiments of the invention may be devised without departing from the basic scope thereof, and the scope thereof is determined by the claims that follow.

The invention claimed is:

1. A top drive system, comprising:
- a quill;
- a motor operable to rotate the quill;
- an adapter bi-directionally rotationally coupled to the quill;
- a connector having an opening for receiving the adapter and at least one radially movable member that is extendable into the opening to engage the adapter to longitudinally couple the connector to the adapter;
- a gripper depending from the adapter and operable to engage a joint of casing; and
- a compensator operable to allow relative longitudinal movement between the connector and the quill.

2. The system of claim 1, further comprising a support longitudinally coupled to the motor or the quill, wherein the compensator is operable to allow the connector to engage with the support.

3. The system of claim 2, wherein the support is rotationally coupled to the motor, and the connector comprises a bearing operable to allow relative rotation between the connector and the support.

4. The system of claim 2, further comprising a hydraulic swivel in fluid communication with a bore of the quill and a bore of the connector.

5. The system of claim 1, further comprising:
- a strain gage disposed on the quill, the strain gage operable to measure torque exerted on the quill; and
- a transmitter disposed on the quill and in communication with the strain gage, the transmitter operable to wirelessly transmit the torque measurement to a stationary interface.

6. The system of claim 5, further comprising an inductive coupling comprising a first sub-coupling disposed on the quill and a second sub-coupling disposed in the interface and in communication with the strain gage, the inductive coupling operable to transfer electricity from the interface to the strain gage.

7. The system of claim 1, wherein the connector comprises:
- a body coupled to the compensator, and
- the adapter having a shoulder extending from an outer surface thereof, wherein the at least one radially movable member includes two or more plates radially movable relative to the body between an extended position and a retracted position, the plates operable to engage the shoulder in the extended position, thereby longitudinally coupling the adapter and the body.

8. The system of claim 7, wherein the body is rotationally coupled to the motor and the adapter comprises a bearing operable to allow relative rotation between the body and the adapter.

9. The system of claim 7, wherein the connector further comprises an actuator operable to move the plates between the positions.

10. The system of claim 1, wherein:
- the quill and the adapter each has a bore formed therethrough, the system further comprises a seal disposed around the outer surface of the quill, and the seal engages an inner surface of the adapter, thereby isolating fluid communication between the quill and adapter bores.

11. The system of claim 10, further comprising a first conduit extending along the quill to the adapter and a second conduit extending from the adapter to the gripper, wherein the connector connects the two conduits.

12. The system of claim 1, wherein:

the gripper comprises a body and slips, the slips are moveable along an inclined surface of the body between an engaged position where the slips engage the casing and a disengaged position where the slips are released from the casing.

13. The system of claim 1, wherein:

the connector comprises a body or shaft and an actuator, the actuator is operable to move the at least one radially movable member between an engaged position and a disengaged position, and the adapter is longitudinally coupled to the compensator when the at least one radially movable member is in the engaged position and releasable from the quill in the disengaged position.

14. The system of claim 13, further comprising a second adapter having a first end engageable with the adapter and a second end having a threaded coupling engageable with drill pipe.

15. The system of claim 1, further comprising:

a manifold located proximate to the motor;

a swivel located proximate to the gripper;

a first hydraulic, pneumatic, or electric conduit extending from the manifold to the swivel; and a second hydraulic, pneumatic, or electric conduit extending from the swivel to the gripper.

16. A top drive system, comprising:

a top drive;

a quill for transmitting torque from the top drive;

an adapter coupled to the quill;

a gripper depending from the adapter and operable to engage a joint of casing; and a connector assembly having a body coupled to the top drive, and having at least one member that is radially movable relative to the body and into engagement with the adapter, wherein the quill is rotatable relative to the body while the connector assembly supports the adapter.

17. The system of claim 16, wherein the top drive includes a body, and wherein the body of the connector assembly is rotationally fixed but longitudinally movable relative to the body of the top drive.

18. The system of claim 16, wherein the at least one member is rotatable relative to the body of the connector assembly.

19. The system of claim 16, wherein the quill is bi-directionally rotationally coupled to the adapter.

20. The system of claim 16, wherein the at least one member is a plate member that is operable to engage a shoulder of the adapter.

21. The system of claim 16, wherein the at least one member is a plate member that is operable to engage a slot within the adapter.

22. The system of claim 16, wherein the at least one member is movable out of engagement with the adapter so that the adapter is movable out of engagement with the quill.

23. A top drive system, comprising:

an adapter coupled to a quill and operable to transmit torque from the quill to a gripper that depends from the adapter;

a connector having an opening for receiving the adapter, wherein the connector includes at least one radially movable member that is extendable into the opening of the connector to engage the adapter.

24. The system of claim 23, further comprising a seal disposed around an outer surface of the quill and engaged with an inner surface of the adapter.

25. The system of claim 23, wherein the quill includes one or more prongs engaged with one or more splines of the adapter to rotationally couple the quill to the adapter.

26. The system of claim 23, wherein the opening is disposed through a center of a body of the connector.

27. The system of claim 23, wherein the adapter is bi-directionally rotationally coupled to the quill, and wherein the at least one radially movable member is extendable into the opening to engage a shoulder or a slot of the adapter to longitudinally couple the connector to the adapter.

28. The system of claim 23, wherein the at least one radially movable member is rotatable relative to a body of the connector when engaged with the adapter.

29. A top drive system, comprising:

a top drive having a body;

a quill for transmitting torque from the top drive;

an adapter for transmitting torque from the quill to a gripper that depends from the adapter; and a connector assembly having a body that is rotationally fixed to the body of the top drive but is longitudinally movable relative to the body of the top drive, and having at least one member that is movable into engagement with the adapter that is rotationally coupled to the quill.

30. The system of claim 29, wherein the quill is rotatable relative to the body of the connector assembly.

31. The system of claim 29, wherein the at least one member is rotatable relative to the body of the connector assembly.

32. The system of claim 29, wherein the at least one member is movable out of engagement with the adapter to release the adapter from engagement with the quill.

* * * * *